US006224334B1

(12) United States Patent
Siga et al.

(10) Patent No.: US 6,224,334 B1
(45) **Date of Patent: *May 1, 2001**

(54) STEAM TURBINE, ROTOR SHAFT THEREOF, AND HEAT RESISTING STEEL

(75) Inventors: Masao Siga; Yutaka Fukui, both of Hitachi; Mitsuo Kuriyama, Ibaraki-ken; Yoshimi Maeno, Hitachi; Masateru Suwa, Ibaraki-ken; Ryoichi Kaneko; Takeshi Onoda, both of Hitachi; Hidefumi Kajiwara; Yasuo Watanabe, both of Katsuta; Shintaro Takahashi, Hitachi; Toshimi Tan, Katsuta, all of (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/780,441

(22) Filed: Jan. 8, 1997

Related U.S. Application Data

(62) Division of application No. 08/530,960, filed on Sep. 20, 1995, now Pat. No. 5,624,235, which is a division of application No. 08/461,521, filed on Jun. 5, 1995, now Pat. No. 5,569,338, which is a division of application No. 08/305,186, filed on Sep. 13, 1994, now Pat. No. 5,536,146, which is a division of application No. 07/893,079, filed on Jun. 3, 1992, now Pat. No. 5,383,768, which is a continuation-in-part of application No. 07/472,838, filed on Jan. 31, 1990, now abandoned.

(30) Foreign Application Priority Data

Feb. 3, 1989 (JP) ..... 1-023890
May 22, 1989 (JP) ..... 1-126622

(51) Int. Cl.[7] ..... F01D 5/28
(52) U.S. Cl. ..... 415/199.5; 415/200; 415/101; 415/103; 416/241 R

(58) Field of Search ..... 415/99–103, 179, 415/198.1, 199.5, 200; 416/241 R; 60/39.182, 39.75, 752, 679; 431/350

(56) References Cited

U.S. PATENT DOCUMENTS 3,417,809 * 12/1968 Sink ..... 416/241 R
3,703,007 * 11/1972 Rice ..... 60/39.182

(List continued on next page.)

FOREIGN PATENT DOCUMENTS

0139210 * 9/1947 (AU) ..... 416/241 R (List continued on next page.)

OTHER PUBLICATIONS

Patent Abstracts of Japan vol. 10, No. 339 (C–385) Nov. 15, 1986 & JP–61–143523 A (Toshiba Corp) Jul. 1, 1986 abstract.

(List continued on next page.)

*Primary Examiner*—Christopher Verdier
(74) *Attorney, Agent, or Firm*—Antonelli, Terry, Stout & Kraus, LLP

(57) ABSTRACT

A steam turbine comprising a rotor shaft integrating high and low pressure portions provided with blades at the final stage thereof having a length not less than 30 inches, wherein a steam temperature at first stage blades is 530° C., a ratio (L/D) of a length (L) defined between bearings of the rotor shaft to a diameter (D) measured between the terminal ends of final stage blades is 1.4 to 2.3. This rotor shaft is composed of heat resisting steel containing by weight 0.15 to 0.4% C, not more than 0.1% Si, 0.05 to 0.25% Mn, 1.5 to 2.5% Ni, 0.8 to 2.5% Cr, 0.8 to 2.5% Mo and 0.15 to 0.35% V and, further, the heat resisting steel may contain at least one of Nb, Ta, W, Ti, Al, Zr, B, Ca, and rare earth elements.

10 Claims, 11 Drawing Sheets

U.S. PATENT DOCUMENTS

| | | | | |
|---|---|---|---|---|
| 3,817,654 | * | 6/1974 | Sohma | 415/103 |
| 4,063,939 | * | 12/1977 | Weaver et al. | 416/241 R |
| 4,090,813 | * | 5/1978 | Minato et al. | 416/241 R |
| 4,465,429 | * | 8/1984 | Martin et al. | 415/199.5 |
| 4,621,499 | * | 11/1986 | Mori et al. | 60/752 |
| 4,677,035 | * | 6/1987 | Fielder et al. | 416/241 R |
| 4,825,522 | * | 5/1989 | Iwai et al. | 416/241 R |
| 4,850,187 | * | 7/1989 | Siga et al. | 416/241 R |
| 4,988,266 | * | 1/1991 | Nakamura et al. | 416/214 R |

FOREIGN PATENT DOCUMENTS

| | | | | |
|---|---|---|---|---|
| 0293526 | * | 12/1953 | (DE) | 415/103 |
| 225425 | | 6/1987 | (EP) . | |
| 237170 | | 9/1987 | (EP) . | |
| 1075879 | * | 7/1967 | (GB) | 416/241 R |
| 2096713 | * | 10/1982 | (GB) | 416/241 R |
| 0298127 | * | 1/1989 | (GB) | 416/241 R |
| 47-29090 | | 7/1972 | (JP) . | |
| 51-103817 | | 9/1976 | (JP) . | |
| 54-145318 | | 11/1979 | (JP) . | |
| 57-94118 | | 6/1982 | (JP) . | |
| 58-34164 | | 2/1983 | (JP) . | |
| 58-096102 | | 6/1983 | (JP) . | |
| 58-167811 | | 10/1983 | (JP) . | |
| 59-096248 | | 6/1984 | (JP) . | |
| 59-190341 | | 10/1984 | (JP) . | |
| 61-221355 | | 10/1986 | (JP) . | |
| 62-083451 | | 4/1987 | (JP) . | |
| 62-165512 | | 7/1987 | (JP) . | |
| 62-180051 | | 8/1987 | (JP) . | |
| 62-189301 | | 8/1987 | (JP) . | |
| 63-157839 | | 6/1988 | (JP) . | |
| 63-38420 | | 7/1988 | (JP) . | |
| 648302 | | 1/1989 | (JP) . | |
| 1230723 | | 9/1989 | (JP) . | |

OTHER PUBLICATIONS

Patent Abstracts of Japan, vol. 10, No. 94, (C–338) Apr. 11, 1986 & JP 60 224766 (Toshiba KK) Nov. 9, 1985 abstract.

Brown Boveri Review, No. 5, 1980 Baden, Ch, pps 227–291 Hausermann et al "Steam Turbines of Medium . . . " p. 281–2, 286.

Revue Alsthom, vol. 12, 1988, p. 3–17, Viallis, J. "65 mw fossil–fiel power plants" p. 8, 1 and right column, figure 6.

JOM—The Journal of Minerals, Mar. 1989, p. 31, Jaffee "Titanium Steam Turbine Blades".

Power, Jun. 1989, Special Section "Steam Turbines and Auxiliaries".

Mitubishi Juhkoh Gihoh vol. 17 No. 2 (1980–3), Development and Design Features of Single Cylinder Reheat Turbine Plant.

Iron and Steel 1984, No. 10, Effect of Miobium and Nickel Additions and Heat Treatment on Mechanical Propeties of 1Cr–1Mo–0.25V Steel, Kawaguchi et al pp. 100–106.

Thermal Power and Nuclear Power Generation vol. 39, No. 6 (Jun. 1988) by R.I. Jaffee et al, pp. 29–36.

Handbook of Mechanical Engineering pp B6–73 (No date).

Toshiba Review, vol. 42, No. 6 (Issued on Jun. 1, 1987) pp. 440–442, entitled "Steam Turbine For Combined Cycle Use".

Steam Turbine For Combined Cycle Use, Hadano et al, pp. 440440–440442, 1987.

* cited by examiner

STEAM TURBINE, ROTOR SHAFT THEREOF, AND HEAT RESISTING STEEL

This is a division of application Ser. No. 08/530,960, filed Sep. 20, 1995 (now U.S. Pat. No. 5,624,235) which is a division of application Ser. No. 08/461,521, filed Jun. 5, 1995 now U.S. Pat. No. 5,569,338, which is a division of application Ser. No. 08/305,186, filed Sep. 13, 1994 now U.S. Pat. No. 5,536,146, which is a divisional application of U.S. Ser. No. 07/893,079 filed Jun. 3, 1992 now U.S. Pat. No. 5,383,768, which is a continuation-in-part application of U.S. Ser. No. 07/472,838 filed Jan. 31, 1990 (now abandoned).

BACKGROUND OF THE INVENTION

1. Field of the Invention

The present invention relates to a novel steam turbine, and more specifically, to a steam turbine provided with a rotor integrating high and low pressure portions fabricated from Ni—Cr—Mo—V low alloy steel having superior high temperature strength and toughness, the rotor shaft thereof, heat resisting steel, and a manufacturing method thereof.

2. Description of the Prior Art

In general, Cr—Mo—V steel specified in accordance with ASTM (Designation: A470-84, Class 8) is used as a material of a high pressure rotor exposed to high temperature steam (steam temperature: about 538° C.) and 3.5 Ni—Cr—Mo—V steel specified in accordance with ASTM (Designation: A470-84, Class 7) is used as a material of a low pressure (steam temperature: about 100° C.) rotor. The former Cr—Mo—V steel is superior in high temperature strength, but inferior in low temperature toughness. The latter 3.5 Ni—Cr—Mo—V steel is superior in low temperature toughness, but inferior in high temperature strength.

A turbine having a large capacity comprises a high pressure portion, an intermediate pressure portion, and a low pressure portion in accordance with the steam conditions thereof, and high and intermediate pressure rotors are fabricated from Cr—Mo—V steel and a low pressure rotor is fabricated from 3.5 Ni—Cr—Mo—V steel.

Turbines having a small capacity less than 100,000 and an intermediate capacity of 100,000 to 300,000 KW have a rotor small in size and thus if a material having both the advantages of the above materials used in the high and low pressure rotors is available, the high and the low pressure portions thereof can be integrated (fabricated from the same material). This integration makes the turbine compact as a whole and the cost thereof is greatly reduced. An example of a material of the rotor integrating high and low pressure portions is disclosed in Japanese Patent Publication No. 58-11504 and in Japanese Patent Laid-Open Publication Nos. 54-40225 and 60-224766.

If the high and low pressure portions are integrated by using the currently available rotor materials, i.e., Cr—Mo—V steel or Ni—Cr—Mo—V steel, the former cannot provide safety against the brittle fracture of the low pressure portion, because it is inferior in low temperature toughness, while the latter cannot provide safety against the creep fracture of the high pressure portion because it is inferior in high temperature strength.

The above-mentioned Japanese Patent Publication No. 58-11504 discloses a rotor integrating high and low pressure portions fabricated from a material consisting, by weight, of 0.15 to 0.3% C, not more than 0.1% Si, not more than 1.0% Mn, 0.5 to 1.5% Cr, 0.5 to 1.5% Ni, not more than 1.5% but more than 0.5% Mo, 0.15 to 0.30% V, 0.01 to 0.1% Nb, and the balance Fe, but it does not exhibit sufficient toughness after heated at a high temperature for a long time and thus long blades having a length not less than 30 inches cannot be planted thereon.

Japanese Patent Laid-open Publication No. 60-224766 discloses a steam turbine rotor fabricated from a material consisting, by weight, of 0.10 to 0.35% C, not more than 0.10% Si, not more than 1.0% Mn, 1.5 to 2.5% Ni, 1.5 to 3.0% Cr, 0.3 to 1.5% Mo, 0.05 to 0.25% V, and the balance Fe, and further discloses that this material may contain 0.01 to 0.1% Nb, and 0.02 to 0.1% N. This rotor, however, is inferior in creep rupture strength.

Japanese Patent Laid-open Publication No. 62-189301 discloses a steam turbine integrating high and low pressure portions, which, however, uses a rotor shaft fabricated by mechanically combining a material superior in high temperature strength but inferior in toughness and a material superior in toughness but inferior in high temperature strength, and thus it is not fabricated from a material having the same component. This mechanical combination requires a large structure to obtain strength and thus the rotor shaft cannot be made small in size and, in addition, the reliability is impaired.

Japanese Patent Laid-open Publication No. 63-157839 discloses a low alloy steel containing alloy composition for a steam turbine rotor, the Fe-base containing, by weight, 0.01–0.35% C, 0.35% or less Si, 1% or less Mn, 1.1–2.5% Ni, 1.5–3.5% Cr, 0.3–1.5% Mo, and 0.1–2.0% W. The rotor may contain at least one of 0.01–0.15% Nb, 0.01–0.10% N, and 0.002–0.015% B. However, the cited publication does not disclose a steel containing not more than 0.20% Mn and having the particular Mn/Ni ratio limited in the present invention. In addition, in the cited publication, there is no teaching of the important points of the present invention described hereinafter, i.e., that the steam inlet temperature of the steam turbine is made to be not less than 530° C. and that the steam outlet temperature at the final stage blades is made not more than 100° C.

SUMMARY OF THE INVENTION

(1) Object of the Invention

An object of the present invention is to provide a small steam turbine having movable blades having a length not less than 30 inches at the final stage and a rotor shaft integrating high and low pressure portions, and capable of producing a large output by a single turbine.

Another object of the present invention is to provide a rotor shaft having superior high temperature strength and less heating embrittlement, heat resisting steel, and a manufacturing method thereof.

(2) Statement of the Invention

The present invention provides a steam turbine having a rotor provided with multi-stage blades planted (fixed) on an integrated (mono-block) rotor shaft thereof from the high pressure side to the low pressure side of steam and a casing covering the rotor, the rotor shaft being fabricated from Ni—Cr—Mo—V low alloy steel having a bainite structure, wherein a ratio (Mn/Ni) is not more than 0.12 or a ratio (Si+Mn)/Ni is not more than 0.18 by weight, and a 538° C., 100,000 hour creep rupture strength is not less than 11 $kgf/mm^2$.

The above rotor shaft is fabricated from Ni—Cr—Mo—V low alloy steel having a bainite structure and containing, by weight, 0.15 to 0.4% C, not more than 0.1% Si, 0.05 to 0.25% Mn, 1.5 to 2.5% Ni, 0.8 to 2.5% Cr, 0.8 to 2.5% Mo, and 0.1 to 0.3% V, wherein a ratio (Mn/Ni) is not more than 0.12 or a ratio (Si+Mn)/Ni is not more than 0.18.

A steam turbine according to the present invention is fabricated from Ni—Cr—Mo—V low alloy steel having a bainite structure, wherein a temperature at the steam inlet of the steam turbine is not less than 530° C., a temperature of the steam outlet thereof is not more than 100° C., at least blades provided at the final stage thereof have a length not less than 30 inches, the above-described rotor shaft is provided at the center thereof with FATT of a temperature not more then the steam outlet temperature and is made of Ni—Cr—Mo—V low alloy steel having a bainite structure and having 100,000 hour creep rupture strength not less than 11 kgf/mm$^2$, and more preferably not less than 12 kgf/mm$^2$ at a temperature not more than the above steam outlet temperature and at 538° C.

A steam turbine according to the present invention has a rotor shaft fabricated from Ni—Cr—Mo—V low alloy steel having a bainite structure and having a 538° C., 100,000 creep rupture strength not less than 11 kgf/mm$^2$, a V-shaped notch impact value of not less than 3.0 kgf-m/cm$^2$ after the rotor shaft has been heated at 500° C. for 1,000 hours, and the blades at least at the final stage thereof have a length not less than 30 inches.

A steam turbine according to the present invention has a steam inlet temperature not less than 530° C. at the steam inlet of the first stage blades thereof and a steam outlet temperature not more than 100° C. at the steam outlet of the final stage blades thereof, a ratio (L/D) of a length (L) between bearings of the rotor shaft to a diameter (D) measured between the extreme ends of the final blade portion is 1.4 to 2.3, and the blades at least at the final stage thereof have a length not less than 30 inches.

The above rotor shaft is fabricated from Ni—Cr—Mo—V low alloy steel having a bainite structure, and this low alloy steel has high temperature strength withstanding the above steam temperature not less than 530° C. and impact value withstanding impacts occurring when the above blades having a length at least 30 inches are planted.

The above blades on a low pressure side have a length not less than 30 inches, the blades on a high pressure side are fabricated from high-Cr martensitic steel having creep rapture strength superior to that of the material of the blades on the low pressure side, and the blades on the low pressure side are fabricated from high-Cr martensitic steel having toughness higher than that of the material of the blades on the high pressure side.

The above-mentioned blades having a length not less than 30 inches are fabricated from martensitic steel containing by weight 0.08 to 0.15% C, no: more than 0.5% Si, not more than 1.5% Mn, 10 to 13% Cr, 1.0 to 2.5% Mo, 0.2 to 0.5% V and 0.02 to 0.1% N, while the above-mentioned blades on the high pressure side are fabricated from martensitic steel containing by weight 0.2 to 0.3% C, not more than 0.5% Si, not more than 1% Mn, 10 to 13% Cr, not more than 0.5% Ni, 0.5 to 1.5% Mo, 0.5 to 1.5% W and 0.15 to 0.35% V, and the above blades on the low pressure side having a length not more than 30 inches are fabricated from martensitic steel consisting, by weight, of 0.05 to 0.15% C, not more than 0.5% Si, not more than 1% and preferably 0.2 to 1.0% Mn, 10 to 13% Cr, not more than 0.5% Ni, not more than 0.5% Mo, and the balance Fe and incidental impurities.

The leading edge-portion at the extreme end of the above blades having a length not less than 30 inches is preferably provided with an erosion-preventing layer. The blade practically has a length of 33.5 inches, 40 inches, 46.5 inches and so forth.

The present invention also provides a combined generator system by which a single generator is simultaneously driven by a steam turbine and a gas turbine, wherein the steam turbine has a rotor provided with multi-stage blades planted on the integrated rotor shaft thereof from a high pressure side to a low pressure side of steam and a casing covering the rotor, a temperature at the steam inlet of the steam turbine is not less than 530° C. and a temperature at the steam outlet thereof is not more than 100° C., the casing is integrally arranged from the high pressure side of the blades to the low pressure side thereof, the steam inlet is disposed upstream of the first stage of the above blades and the steam outlet is disposed downstream of the final stage of the above blades to enable the above steam to flow in one direction, and the above blades on the low pressure side have a length not less than 30 inches.

The present invention can employ the above-mentioned rotor for a steam turbine having a rotor provided with multi-stage blades planted on the integrated rotor shaft thereof from a high pressure side to a low pressure side of steam and a casing covering the rotor, wherein the steam flows in different directions when comparing the case of the high pressure side with the low pressure side.

Stationary blades in the present invention are fabricated from an annealed wholly martensitic steel consisting, by weight, of 0.05 to 0.15% C, not more than 0.5% Si, 0.2 to 1% Mn, 10 to 13% Cr, not more than 0.5% Ni, not more than 0.5% Mo, and the balance Fe and incidental impurities.

A casing according to the present invention is fabricated from a Cr—Mo—V cast steel having a bainite structure and containing by weight 0.15 to 0.30% C, more than 0.5% Si, 0.05 to 1.0% Mn, 1 to 2% Cr, 0.5 to 1.5% mo, 0.05 to 0.2% V and not more than 0.05% Ti.

The present invention provides a heat resisting steel of Ni—Cr—Mo—V steel having a bainite structure and containing by weight 0.15 to 0.4% C, not more than 0.1% Si, 0.05 to 0.25% Mn, 1.5 to 2.5% Ni, 0.8 to 2.5% Cr, 0.8 to 2.5% Mo, and 0.10 to 0.35% V, wherein a ratio Mn/Ni is not more than 0.12 or a ratio (Si+Mn)/Ni is not more than 0.18.

The present invention provides a heat resisting steel of Ni—Cr—Mo—V steel having a bainite structure and containing by weight 0.15 to 0.4% C, not more than 0.1% Si, 0.05 to 0.25% Mn, 1.5 to 2.5% Ni, 0.8 to 2.5% Cr, 0.8 to 2.5% Mo, 0.10 to 0.30% V, and 0.001 to 0.1% in total at least one selected from the group consisting of Al, Zr, Ca, and rare earth elements, wherein a ratio Mn/Ni is not more than 0.12 or a ratio (Si+Mn)/Ni is not more than 0.18.

The present invention provides a heat resisting steel of Ni—Cr—Mo—V steel mainly having a bainite structure and containing by weight 0.15 to 0.4% C, not more than 0.1% Si, 0.05 to 0.25% Mn, 1.5 to 2.5% Ni, 0.8 to 2.5% Cr, 0.8 to 2.5% Mo, 0.10 to 0.30% V, and 0.005 to 0.15% at least one selected from the group consisting of Nb and Ta, wherein a ratio (Mn/Ni) is not more than 0.12 or a ratio (Si+Mn)/Ni is not more than 0.18.

The present invention provides a heat resisting steel of Ni—Cr—Mo—V steel having a bainite structure and containing by weight 0.15 to 0.4% C, not more than 0.1% Si, 0.05 to 0.25% Mn, 1.5 to 2.3% Ni, 0.8 to 2.5% Cr, 0.8 to 2.5% Mo, 0.10 to 0.30% V, 0.001 to 0.1% in total at least one selected from the group consisting of Al, Zr, Ca, and rare earth elements, and 0.005 to 0.15% at least one selected from the group consisting of Nb and Ta, wherein a ratio (Mn/Ni) is not more than 0.12 or a ratio (Si+Mn)/Ni is not more than 0.18.

The present invention provides a Ni—Cr—Mo—V low alloy steel containing by weight 0.15 to 0.4% C, not more than 0.1% Si, 0.05 to 0.5% Mn, 1.6 to 2.5% Ni, 0.8 to 2.5% Cr, 0.8 to 2.5% Mo, 0.1 to 0.5% V, and the balance Fe and incidental impurities, wherein a ratio (V+Mo)/(Ni+Cr) is 0.45 to 0.7, and also a rotor shaft integrating high and low pressure portions which rotor shaft is made of the Ni—Cr—Mo—V low alloy steel.

The present invention provides a Ni—Cr—Mo—V low alloy steel consisting, by weight, of 0.15 to 0.4% C, not more than 0.1% Si, 0.05 to 0.5% Mn, 1.6 to 2.5% Ni, 0.8 to 2.5% Cr, 0.8 to 2.5% Mo, 0.1 to 0.5% V, at least one selected from the group consisting of 0.005 to 0.15% Nb, 0.005 to 0.15% Ta, 0.001 to 0.1% Al, 0.001 to 0.1% Zr, 0.001 to 0.1% Ca, 0.001 to 0.1% rare Earth elements, 0.1 to 1.0% W, 0.001 to 0.1% Ti, 0.001 to 0.1% B, and the substantial balance Fe and incidental impurities, wherein a ratio (V+Mo)/(Ni+Cr) is 0.45 to 0.7, and to a rotor shaft integrating high and low pressure portions using this Ni—Cr—Mo—V low alloy steel.

These rotor shafts are applied to a steam turbine according to the present invention.

Further, an amount of oxygen contained in the above Cr—Mo—V low alloy steels is preferably not more than 25 ppm.

A method of manufacturing the Cr—Mo—V steel having the composition described above comprises the steps of forming a steel ingot thereof particularly by melting the ingot by electroremelting or in an arc furnace under an atmospheric air and then by deoxidizing the same through carbon under vacuum, hot forging the steel ingot, quenching the steel ingot in such a manner that it is heated to an austenizing temperature and then cooled at a predetermined cooling speed, and annealing the steel ingot, the Cr—Mo—V steel mainly having a bainite structure.

Preferably, the quenching temperature is 900 to 1000° C. and an annealing temperature is 630 to 700° C.

A steam turbine according to the present invention is most suitably applied to a thermal power plant having an intermediate capacity of 100,000 to 300,000 KW from a view point that it is compact in size and has an improved thermal efficiency. In particular, the steam turbine is provided with the longest blades having a length of 33.5 inches and at least ninety pieces of the blades can be planted around the overall circumference thereof.

[Operation]

The component of the low alloy steel constituting the steam turbine rotor of the present invention and the reason why heat treatment conditions are limited are explained below.

Carbon is an element necessary to improve quenching ability and to obtain strength. When an amount thereof is not more than 0.15%, sufficient quenching ability cannot be obtained and a soft ferritic structure occurs about the center of the rotor, so that sufficient tensile strength and yield strength can not be obtained. When a content thereof is not less than 0.4%, it reduces toughness. Thus, the carbon is limited to a range from 0.15 to 4.0%, and, in particular, preferably limited to a range from 0.20 to 0.28%.

Although silicon and manganese are conventionally added as a deoxidizer, a rotor superior in quality can be produced without the addition thereof when a steel making technology such as a vacuum carbon deoxidation method or an electro-slug melting method is used. A content of Si and Mn must be made as low as possible from a view point that the rotor is made brittle when it is operated for a long time, and thus the amounts thereof are limited to not more than 0.1% and 0.5%, respectively, and in particular, Si ≦0.05% and Mn ≦0.25% are preferable and Mn ≦0.15% is more preferable. Mn not less than 0.05% acts as a desulfurizing agent and is necessary to enhance hot workability. Thus, the lower limit of Mn is 0.05%.

Nickel is indispensable to improve quenching ability and toughness. A content thereof less than 1.5% is not sufficient to obtain an effect for improving toughness. An addition of a large amount thereof exceeding 2.5% lowers creep rupture strength. In particular, preferably an amount thereof is in a range from 1.6 to 2.0%.

Chromium improves quenching ability, toughness, and strength, and also improves corrosion resistance in steam. A content thereof less than 0.8% is not sufficient to exhibit an effect for improving them, and an addition thereof exceeding 2.5% lowers creep rupture strength. In particular, preferably an content thereof is in a range from 1.2 to 1.9%.

Molybdenum precipitates fine carbide in crystal grains while an annealing processing is carried out, with a result that it has an effect for improving high temperature strength and preventing embrittlement caused by annealing. A content thereof less than 0.8% is not sufficient to exhibit this effect, and an addition of a large amount thereof exceeding 2.5% reduces toughness. In particular, preferably a content thereof is in a range from 1.2 to 1.5% from a view point of toughness and preferably a content thereof is in a range exceeding 1.5% but not more than 2.0% from a view point of strength.

Vanadium precipitates fine carbide in crystal grains while an annealing processing is carried out with a result that it has an effect for improving high temperature strength and toughness. A content thereof less than 0.1% is not sufficient to exhibit this effect, but an addition thereof exceeding 0.3% saturates the effect. In particular, preferably the content thereof is in a range from 0.20% to 0.25%.

It has been experimentally clarified that the above-mentioned nickel, chromium, vanadium, and molybdenum are greatly concerned with toughness and high temperature strength and act in combination in the invented steel. More specifically, to obtain a material superior in both high temperature strength and low temperature toughness, a ratio of a sum of vanadium and molybdenum, which are carbide creating elements and which have an effect for improving high temperature strength, to a sum of nickel and chromium, which have an effect for improving quenching ability and toughness, preferably satisfies the equation (V+Mo)/(Ni+Cr) 0.45 to 0.7.

When low alloy steel composed of the above component is manufactured, an addition of any of rare earth elements, calcium, zirconium, and aluminum improves the toughness thereof. An addition of rare earth elements less than 0.005% is not sufficient to exhibit an effect for improving the toughness, but an addition thereof exceeding 0.4% saturates the effect. Although an addition of a small amount of Ca improves the toughness, an amount thereof less than 0.0005% does not exhibit an effect for improvement, but an addition thereof exceeding 0.01% saturates the effect. An addition of Zr less than 0.01% is not sufficient to exhibit an effect for improving the toughness, but an addition thereof exceeding 0.2% saturates the effect. An addition of Al less than 0.001% is not sufficient to exhibit an effect for improving the toughness, but an addition thereof exceeding 0.02% lowers creep rupture strength.

Further, oxygen is concerned with high temperature strength, and superior creep rapture strength can be obtained by controlling an amount of $O_2$ in a range from 5 to 25 ppm in the invented Steel.

At least one of niobium and tantalum is added in an amount of 0.005 to 0.15%. A content thereof less than 0.005% is not sufficient to exhibit an effect for improving strength, whereas when a content thereof exceeds 0.15% the huge carbides thereof are crystallized in such a large structure as a steam turbine rotor, whereby strength and toughness are lowered, and thus this content is in a range from 0.005 to 0.15%. In particular, preferably the content is in a range from 0.01 to 0.05%.

Tungsten is added in an amount not less than 0.1% to increase strength. This amount must be in a range from 0.1 to 1.0%, because when the amount exceeds 1.0%, a problem of segregation arises in a large steel ingot by which strength is lowered, and preferably the amount is in a range from 0.1 to 0.5%.

A ratio Mn/Ni or a ratio (Si+Mn)/Ni must be not more than 0.12 and not more than 0.18, respectively, whereby Ni—Cr—Mo—V low alloy steel having a bainitic structure is greatly prevented from being subjected to heating embrittlement, with the result that the low alloy steel is applicable to a rotor shaft integrating low and high pressure portions.

The steel having the characteristics superior in both creep rupture strength and high impact value can be obtained by setting a ratio (V+Mo)/(Ni+Cr) to 0.45 to 0.7, whereby blades each having a length not less than 30 inches can be planted on the rotor shaft integrating high and low pressure portions according to the present invention.

The application of the above new material to a rotor shaft enables long blades having a length of not less than 30 inches to be planted on the rotor shaft as final stage blades, and the rotor shaft can be made compact such that a ratio (L/D) of a length (L) thereof between bearings to a blade diameter (D), is made to 1.4 to 2.3, and preferably the ratio is made to 1.6 to 2.0. Further, a ratio of the maximum diameter (d) of the rotor shaft to a length (l) of final long blades can be made to 1.5 to 2.0. With this arrangement, an amount of steam can be increased to the maximum thereof in accordance with the characteristics of the rotor shaft, whereby a large amount of power can be generated by a small steam turbine. In particular, preferably this ratio is 1.6 to 1.8. A ratio not less than 1.5 is determined from the number of blades, and the greater the ratio, the better the result can be obtained, but preferably the ratio is not more than 2.0 from a view point of strength with respect to a centrifugal force.

A steam turbine using the rotor shaft integrating high and low pressure portions according to the present invention is small in size, and capable of generating power of 100,000 to 300,000 KW and making a distance thereof between bearings very short, i.e., not more than 0.8 m per 10, 000 KW of generated power. Preferably, the distance is 0.25 to 0.6 m per 10,000 KW.

The application of the above Cr—Mo—V low alloy steel to a rotor shaft integrating high and low pressure portions enables movable blades having a length of not less than 30 inches and in particular not less than 33.5 inches to be planted at a final stage, whereby an output from a single turbine can be increased and the turbine can be made small in size.

According to the present invention, since a steam turbine integrating high and low pressure portions provided with long blades not less than 30 inches can be manufactured, an output from a single turbine, which is small in size, can be greatly increased. Further, there is an effect in that a power generating cost and a cost for constructing a power plant are reduced. Furthermore, according to the present invention, a rotor shaft having superior high temperature strength and less heat embrittlement and superior heat resisting steel can be obtained, and in particular a rotor shaft integrating high and low pressure portions on which blades having a length not less than 30 inches are planted can be obtained.

Particularly, it is preferable that the rotor of a high and low pressure portions integrated type embodying the present invention has a bainite structure consisting, by weight, of 0.20 to 0.26% C, not more than 0.05% Si, 0.15 to 0.25% Mn, 1.6 to 2.0% Ni, 1.8 to 2.5% Cr, 1.0 to 1.5% Mo, more than 0.25% but not more than 0.35% V, preferably 0.26% to 0.30% V, and the balance Fe and incidental impurities. Further, regarding the impurities, it is preferable that P is not more than 0.010%, S is not more than 0.010%, Al not more than 0.008%, Cu not more than 0.10%, Sn not more than 0.010%, As not more than 0.008%, Sb not more than 0.005%, and 0 not more than 0.002%.

BRIEF DESCRIPTION OF THE INVENTION

FIGS. 1, 8, and 9 are partial cross sectional views of a steam turbine using a rotor shaft integrating high and low pressure portions according to the present invention;

PREFERRED EMBODIMENTS OF THE INVENTION

Example 1

Figure 1:
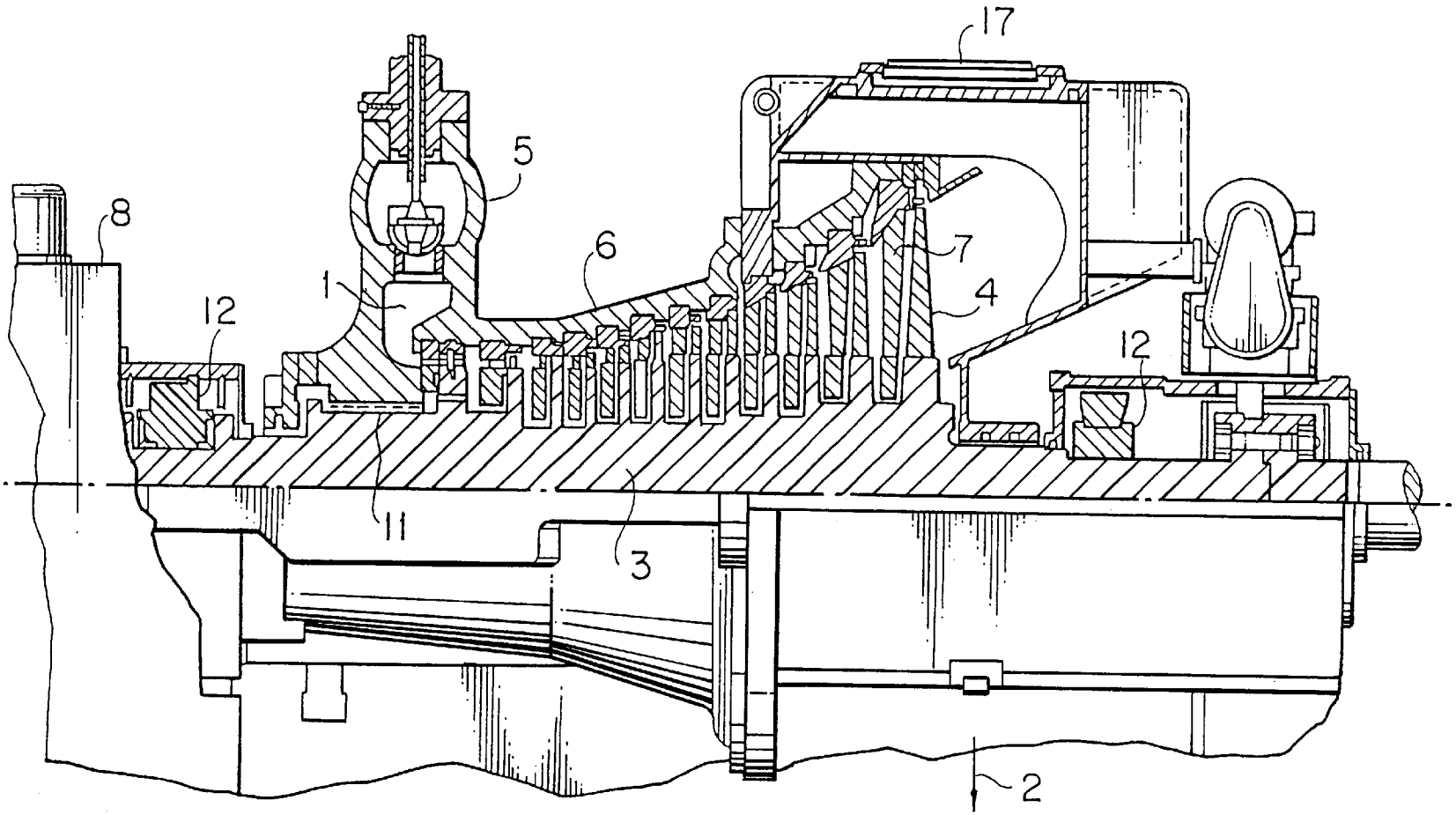

A turbine rotor according to the prevent invention is described below with reference to examples. Table 1 shows chemical compositions of typical specimens subjected to toughness and creep rupture tests, The specimens were obtained in such a manner that they were melted in a high frequency melting furnace, made to an ingot, and hot forged to a size of 30 mm square at a temperature from 850 to 1150° C. The specimens Nos. 1, 3 and 7 to 11 are materials according to the present invention. The specimens Nos. 2, 4 to 6 were prepared for the comparison with the invented materials. The specimen No. 5 is a material corresponding to ASTM A470 Class 8 and the specimen No. 6 is a material corresponding to ASTM A470 Class 7. These specimens were quenched in such a manner that they were made to have austenitic structure by being heated to 950° C. in accordance with a simulation of the conditions of the center of a rotor shaft integrating high and low pressure portions of a steam turbine, and then cooled at a speed of 100° C./h. Next, they were annealed by being heated at 665° C. for 40 hours and cooled in a furnace. Cr—Mo—V steels according to the present invention included no ferrite phase and were made to have a bainite structure as a whole.

An austenitizing temperature of the invented steels must be 900 to 1000° C. When the temperature is less than 900° C., creep rapture strength is lowered, although superior toughness can be obtained. When the temperature exceeds 1000° C., toughness is lowered, although superior creep rupture strength can be obtained. An annealing temperature must be 630 to 700° C. If the temperature is less than 630° C., superior toughness cannot be obtained, and when it exceeds 700° C., superior creep strength cannot be obtained.

Table 2 shows the results of a tensile strength test, impact test, and creep rupture test. Toughness is shown by Charpy impact absorbing energy of a V-shaped notch tested at 20° C. Creep rupture strength is determined by Larason Mirror method and shown by a strength obtained when a specimen was heated at 538° C. for 100,000 hours. As apparent from Table 2, the invented materials have a tensile strength not less than 88 kgf/mm$^2$ at a room temperature, a 0.2% yield strength not less than 70 kgf/mm$^2$, an FATT not more than 40° C., an impact absorbing energy not less than 2.5 kgf-m both before they were heated and after they had been heated, and a creep rupture strength not less than about 11 kg/mm$^2$, and thus they are very useful for a turbine rotor integrating high and low pressure portions. In particular, a material having a strength not less than 15 kg/mm$^2$ is preferable to plant long blades of 33.5 inches.

TABLE 1

| Specimen | Composition (wt %) | | | | | | | | | | V + Mo/ | | Si + Mn/ |
|---|---|---|---|---|---|---|---|---|---|---|---|---|---|
| No. | C | Si | Mn | P | S | Ni | Cr | Mo | V | | Ni + Cr | Mn/Ni | Ni |
| 1 | 0.29 | 0.08 | 0.18 | 0.012 | 0.012 | 1.85 | 1.20 | 1.21 | 0.22 | — | 0.47 | 0.097 | 0.141 |
| 2 | 0.24 | 0.06 | 0.07 | 0.007 | 0.010 | 1.73 | 1.38 | 1.38 | 0.27 | — | 0.53 | 0.040 | 0.075 |
| 3 | 0.27 | 0.04 | 0.15 | 0.007 | 0.009 | 1.52 | 1.09 | 1.51 | 0.26 | — | 0.68 | 0.099 | 0.125 |
| 4 | 0.30 | 0.06 | 0.19 | 0.008 | 0.011 | 0.56 | 1.04 | 1.31 | 0.26 | — | 0.98 | 0.339 | 0.446 |
| 5 | 0.33 | 0.27 | 0.77 | 0.007 | 0.010 | 0.34 | 1.06 | 1.28 | 0.27 | — | 1.11 | 2.265 | 3.059 |
| 6 | 0.23 | 0.05 | 0.30 | 0.009 | 0.012 | 3.56 | 1.66 | 0.40 | 0.12 | — | 0.10 | 0.084 | 0.098 |
| 7 | 0.31 | 0.07 | 0.15 | 0.007 | 0.009 | 2.00 | 1.15 | 1.32 | 0.22 | — | 0.49 | 0.075 | 0.110 |
| 8 | 0.26 | 0.06 | 0.17 | 0.007 | 0.008 | 1.86 | 1.09 | 1.41 | 0.24 | La + Ce 0.20 | 0.56 | 0.091 | 0.124 |
| 9 | 0.25 | 0.07 | 0.17 | 0.010 | 0.010 | 1.72 | 1.40 | 1.42 | 0.24 | Ca 0.005 | 0.53 | 0.099 | 0.140 |
| 10 | 0.24 | 0.05 | 0.13 | 0.009 | 0.007 | 1.73 | 1.25 | 1.39 | 0.25 | Zr 0.04 | 0.55 | 0.075 | 0.104 |
| 11 | 0.26 | 0.03 | 0.09 | 0.008 | 0.009 | 1.71 | 1.23 | 1.45 | 0.23 | Al 0.01 | 0.57 | 0.052 | 0.070 |
| 12 | 0.29 | 0.09 | 0.23 | 0.013 | 0.009 | 1.70 | 1.06 | 1.32 | 0.25 | — | 0.57 | 0.135 | 0.188 |
| 13 | 0.29 | 0.21 | 0.33 | 0.012 | 0.007 | 1.74 | 1.04 | 1.20 | 0.23 | — | 0.51 | 0.190 | 0.310 |
| 14 | 0.31 | 0.25 | 0.90 | 0.010 | 0.007 | 1.86 | 1.06 | 1.29 | 0.22 | — | 0.52 | 0.484 | 0.618 |

TABLE 2

| | Value in parenthesis: after heated at 500° C. for 3000 h | | | | | | |
|---|---|---|---|---|---|---|---|
| Specimen No. | Tensile strength (kg/mm$^2$) | 0.02% yield strength (kg/mm$^2$) | Elongation (%) | Contraction of area (%) | Impact absorbing energy (kg-m) | 50% FATT (° C.) | 538° C. Creep rapture strength (kgf/mm$^2$) |
| 1 | 92.4 | 72.5 | 21.7 | 63.7 | 3.5 (3.3) | 30 (33) | 12.5 |
| 2 | 92.5 | 72.6 | 21.3 | 62.8 | 3.3 (3.0) | 39 (39) | 15.6 |
| 3 | 90.8 | 71.4 | 22.5 | 64.0 | 2.8 (2.7) | 38 (43) | 18.4 |
| 4 | 90.8 | 71.9 | 20.4 | 61.5 | 1.2 | 119 | 15.5 |
| 5 | 88.1 | 69.2 | 20.1 | 60.8 | 1.3 | 120 (135) | 14.6 |
| 6 | 72.4 | 60.1 | 25.2 | 75.2 | 12.0 | −20 (18) | 5.8 |
| 7 | 89.9 | 70.3 | 22.3 | 64.5 | 3.6 (3.3) | 29 (32) | 10.8 |
| 8 | 90.8 | 70.7 | 21.9 | 63.9 | 4.2 | 21 | 14.8 |
| 9 | 91.0 | 71.4 | 21.7 | 63.5 | 3.9 | 25 | 15.1 |
| 10 | 92.0 | 72.2 | 20.9 | 62.2 | 3.7 | 34 | 15.6 |
| 11 | 90.6 | 71.1 | 21.5 | 61.8 | 3.7 | 36 | 15.5 |
| 12 | — | — | — | — | 3.0 (2.4) | 40 (63) | 15.5 |
| 13 | — | — | — | — | 3.4 (2.4) | 36 (63) | 15.1 |
| 14 | — | — | — | — | 3.6 (2.3) | 32 (6.6) | 11.5 |

Figure 2:
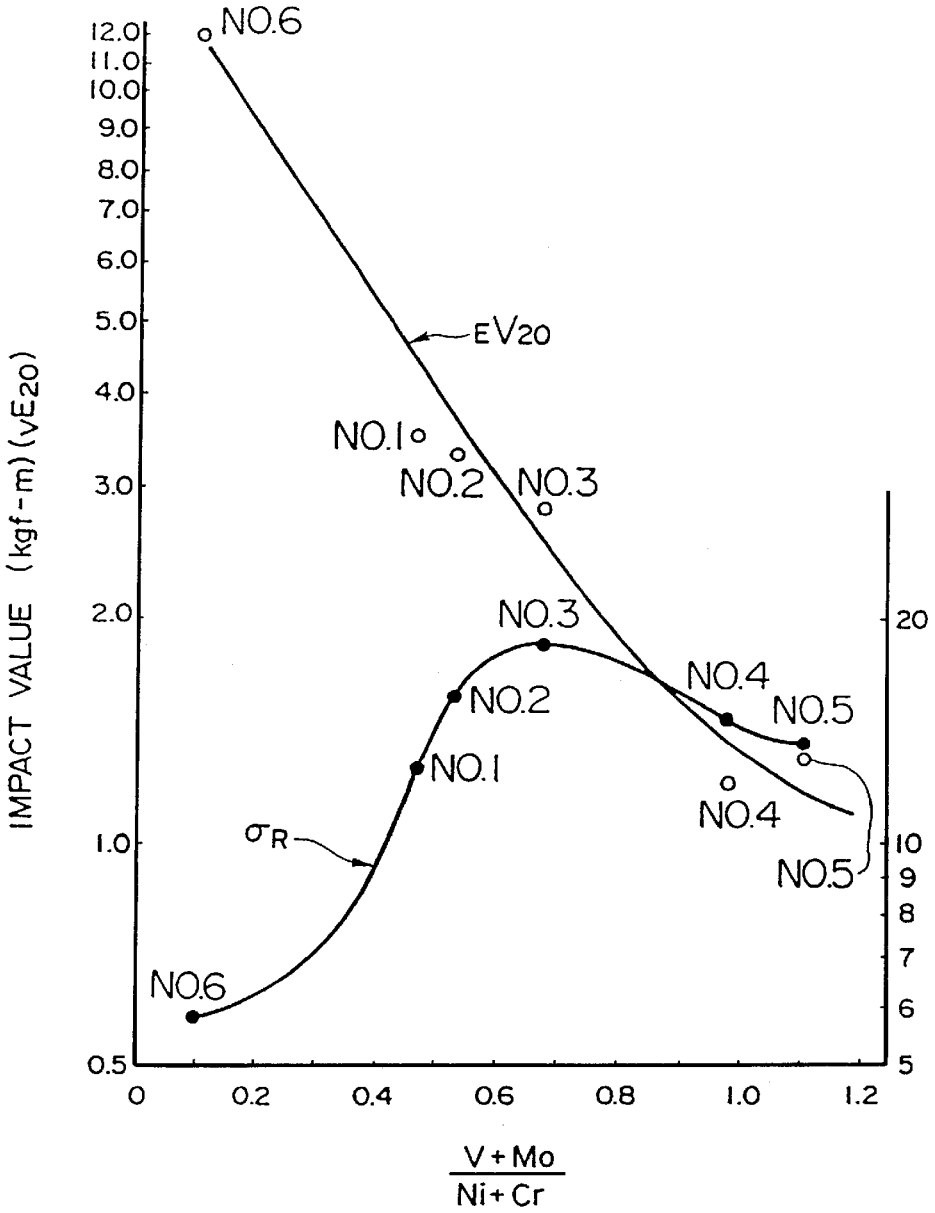
FIG. 2 is a graph showing a relationship between a ratio (V+Mo)/(Ni+Cr), and creep capture strength and impact value.

FIG. 2 shows a relationship between a ratio of a sum of V and Mo acting as carbide creating elements to a sum of Ni and Cr acting as quenching ability improving elements, and creep rupture strength and impact absorbing energy. The creep rupture strength is increased as the component ratio (V+Mo)/(Ni i Cr) is increased until it becomes about 0.7. It is found that the impact absorbing energy is lowered as the component ratio is increased. It is found that the toughness (vE20≧2.5 kgf/m) and the creep rupture strength (6R ≧11 kgf/mm$^2$) necessary as the characteristics of a material forming the turbine rotor integrating high and low pressure portions are obtained when (V+Mo)/(Ni+Cr)=0.45 to 0.7. Further, to examine the brittle characteristics of the invented material No. 2 and the comparative material Nos. 5 (corresponding to a material currently used to a high pressure rotor) and 6 (corresponding to a material currently used to a low pressure rotor), an impact test was effected to specimens before subjected to a brittle treatment for 3000 h at 500° C. and those after subjected to the treatment and a 50% fracture appearance transition temperature (FATT) was examined. FATT of the comparative material No. 5 was increased (made brittle) from 119° C. to 135° C. (ΔFATT=16° C.), FATT of the material No. 6 was increased from −20° C. to 18° C. (ΔFATT=38° C.) and FATT of the material Nos. 12–14 was increased from 32° C.–40° C. to 63° C.–66° C. (ΔFATT=23~34° C.) by the brittle treatment, whereas it was also confirmed that FATT of the invented material were not more than 39° C. (ΔFATT=0° C. to 5° C.) before and after the brittle treatment and thus it was confirmed that this material was not made brittle.

The specimens Nos. 8 to 11 of the invented materials added with rare earth elements (La—Ce), Ca, Zr, and Al, respectively, have toughness improved by these rare earth elements. In particular, the addition of the rare earth elements is effective to improve the toughness. A material added with Y in addition to La—Ce was also examined and it was confirmed that Y was very effective to improve the toughness.

Table 3 shows the chemical compositions and creep rapture strength of the specimens prepared to examine an influence of oxygen to creep rapture strength of the invented materials. A method of melting and forging these specimens were the same as that of the above-mentioned specimens Nos. 1 to 11.

TABLE 3

| Specimen | Composition (wt %) | | | | | | | | | |
|---|---|---|---|---|---|---|---|---|---|---|
| No. | C | Si | Mn | P | S | Ni | Cr | Mo | V | O |
| 15 | 0.26 | 0.05 | 0.08 | 0.008 | 0.011 | 1.71 | 1.24 | 1.37 | 0.25 | 0.0004 |
| 16 | 0.23 | 0.04 | 0.10 | 0.009 | 0.011 | 1.60 | 1.24 | 1.37 | 0.25 | 0.0014 |
| 17 | 0.25 | 0.05 | 0.09 | 0.010 | 0.012 | 1.61 | 1.25 | 1.36 | 0.24 | 0.0019 |
| 18 | 0.24 | 0.05 | 0.12 | 0.008 | 0.010 | 1.65 | 1.20 | 1.38 | 0.24 | 0.0030 |
| 19 | 0.25 | 0.04 | 0.11 | 0.009 | 0.010 | 1.69 | 1.29 | 1.29 | 0.23 | 0.0071 |
| 20 | 0.23 | 0.06 | 0.09 | 0.010 | 0.012 | 1.72 | 1.30 | 1.32 | 0.25 | 0.0087 |

Figure 3:
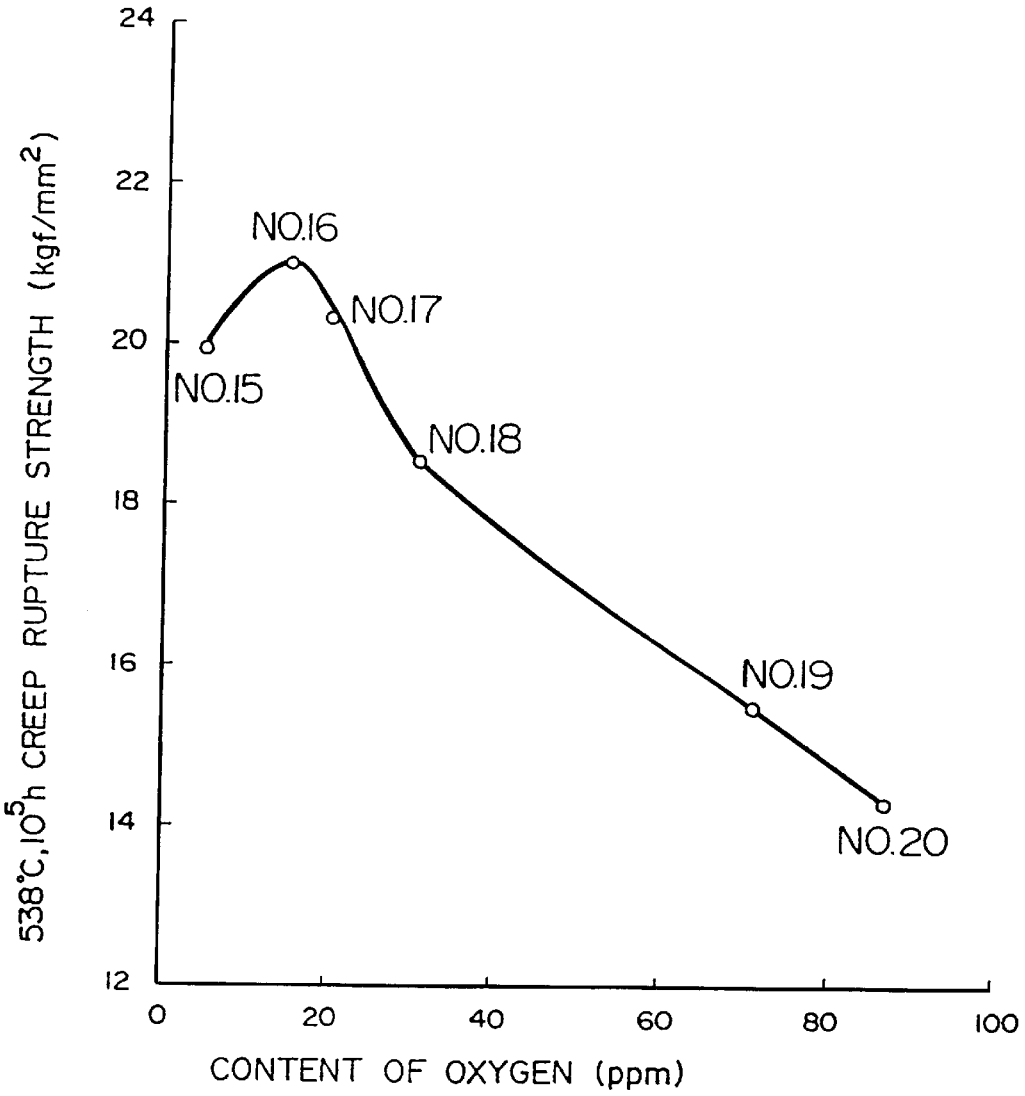
FIG. 3 is a graph showing a relationship between creep rapture strength and oxygen.

The specimens were quenched in such a manner that they were austenitized by being heated to 950° C. and then by being cooled at a speed of 100° C./h. Next, they were annealed by being heated at 660° C. for 40 hours. Table 4 shows 538° C. creep rapture strength in the same manner as that shown in Table 2. FIG. 3 is a graph showing a relationship between creep rupture strength and oxygen. It is found that a superior creep rupture strength not less than about 12 kgf/mm$^2$ can be obtained by making $O_2$ to a level not more than 100 ppm, further, a superior creep rupture strength not less than 15 kgf/mm$^2$ can be obtained by making $O_2$ level thereof be not more than 80 ppm, and furthermore, a superior creep rupture strength not less than 18 kgf/mm$^2$ can he obtained by making $O_2$ level thereof be not more than 40 ppm.

TABLE 4

| Specimen No. | $\frac{Mn}{Ni}$ | $\frac{Si+Mn}{Ni}$ | $\frac{V+Mo}{Ni+Cr}$ | Creep rupture strength (kgf/mm$^2$) |
|---|---|---|---|---|
| 15 | 0.047 | 0.076 | 0.55 | 19.9 |
| 16 | .063 | 0.088 | 0.57 | 21.0 |
| 17 | 0.056 | 0.087 | 0.56 | 20.3 |
| 18 | 0.073 | 0.103 | 0.57 | 18.5 |
| 19 | 0.065 | 0.089 | 0.51 | 15.6 |
| 20 | 0.052 | 0.087 | 0.52 | 14.3 |

Figure 4:
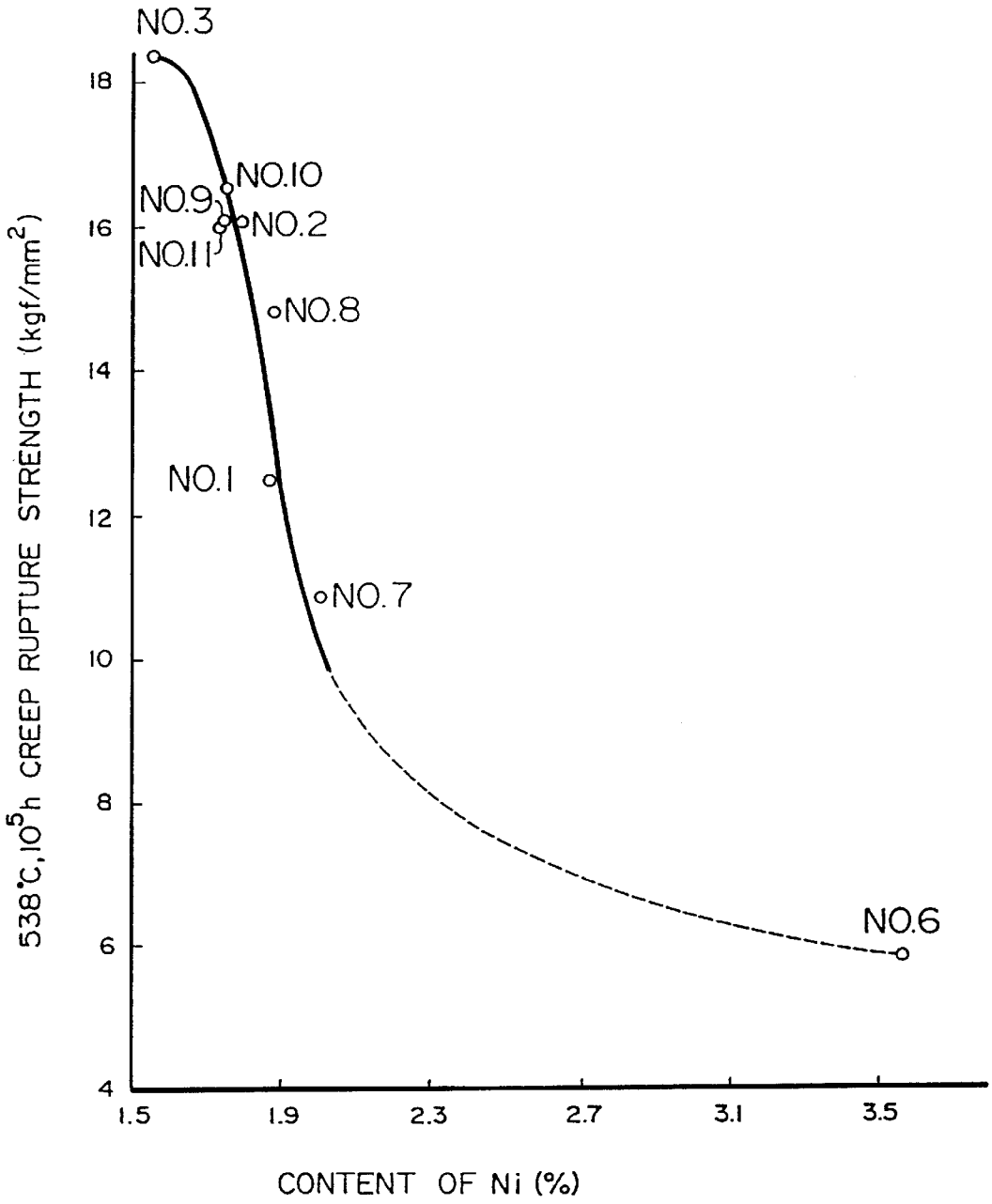
FIG. 4 is a graph showing a relationship between creep rapture strength and Ni.

FIG. 4 is a graph showing a relationship between 538° C., $10^5$ hour creep rupture strength and an amount of Ni. As shown in FIG. 4, the creep rupture strength is abruptly lowered as an amount of Ni is increased. In particular, a creep rupture strength not less than about 11 kgf/mm$^2$ is exhibited when an amount of Ni is not more than about 2%, and in particular, a creep rupture strength not less than about 12 kgf/mm$^2$ is exhibited when an amount of Ni is not more than 1.9%.

Figure 5:
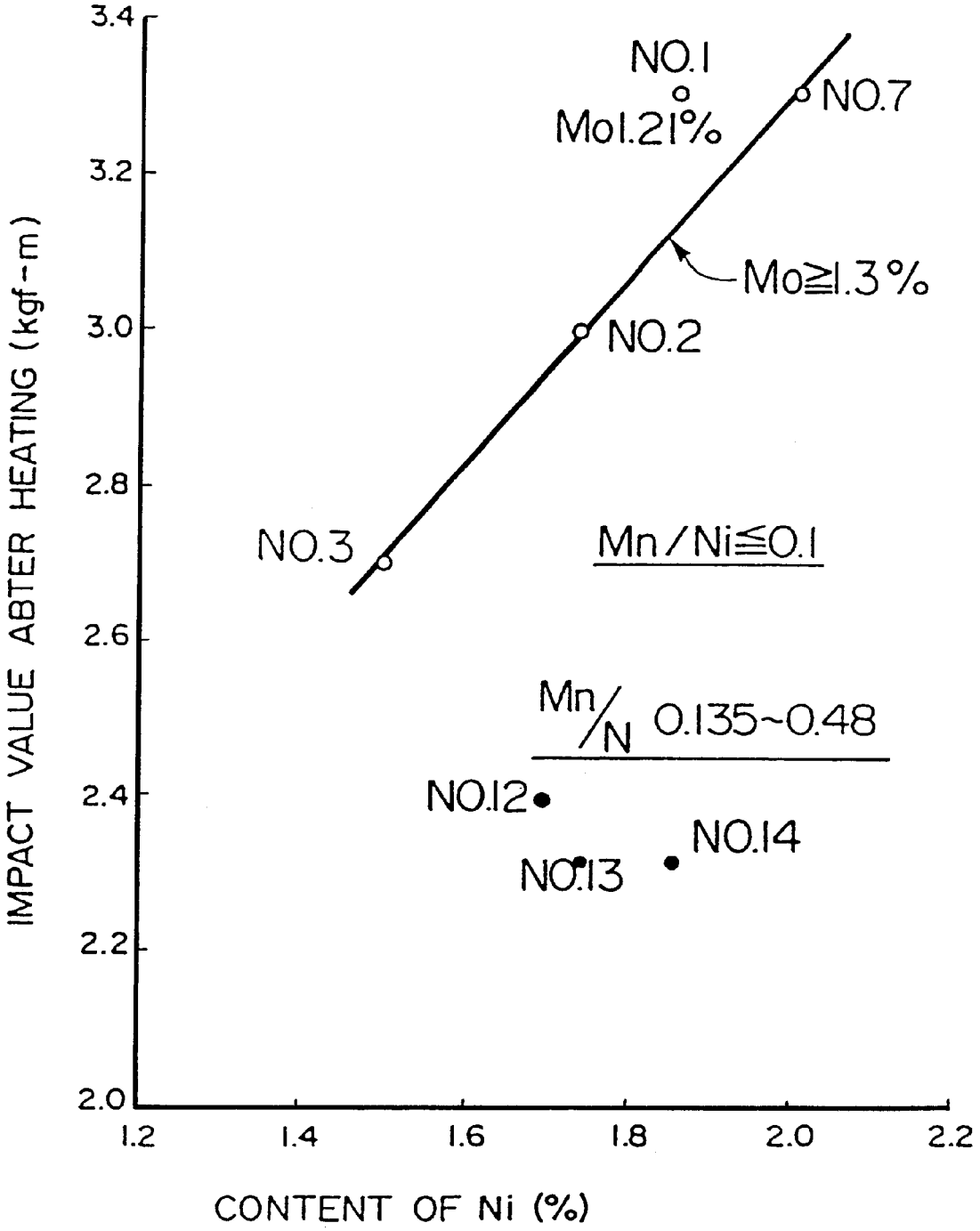
FIG. 5 to FIG. 7 are graphs showing relationships between a V-shaped notch impact value, and Ni, Mn, Si+Mn, a ratio Mn/Ni, and a ratio (Si+Mn)/Ni.

FIG. 5 is a graph showing a relationship between an impact value and an amount of Ni after the specimens have been heated at 500° C. for 3,000 hours. As shown in FIG. 5, the specimens of the present invention in which a ratio (Si+Mn)/Ni is not more than 0.18 or in which another ratio Mn/Ni is not more than 0.1 can bring about high impact value by the increase in an amount of Ni, but the comparative specimens Nos. 12 to 14 in which a ratio (Si+Mn)/Ni exceeds 0.18 or in which another ratio Mn/Ni exceeds 0.12 have a low impact value not more than 2.4 kgf-m, and thus an increase in the amount of Ni is little concerned with the impact value.

Figure 6:
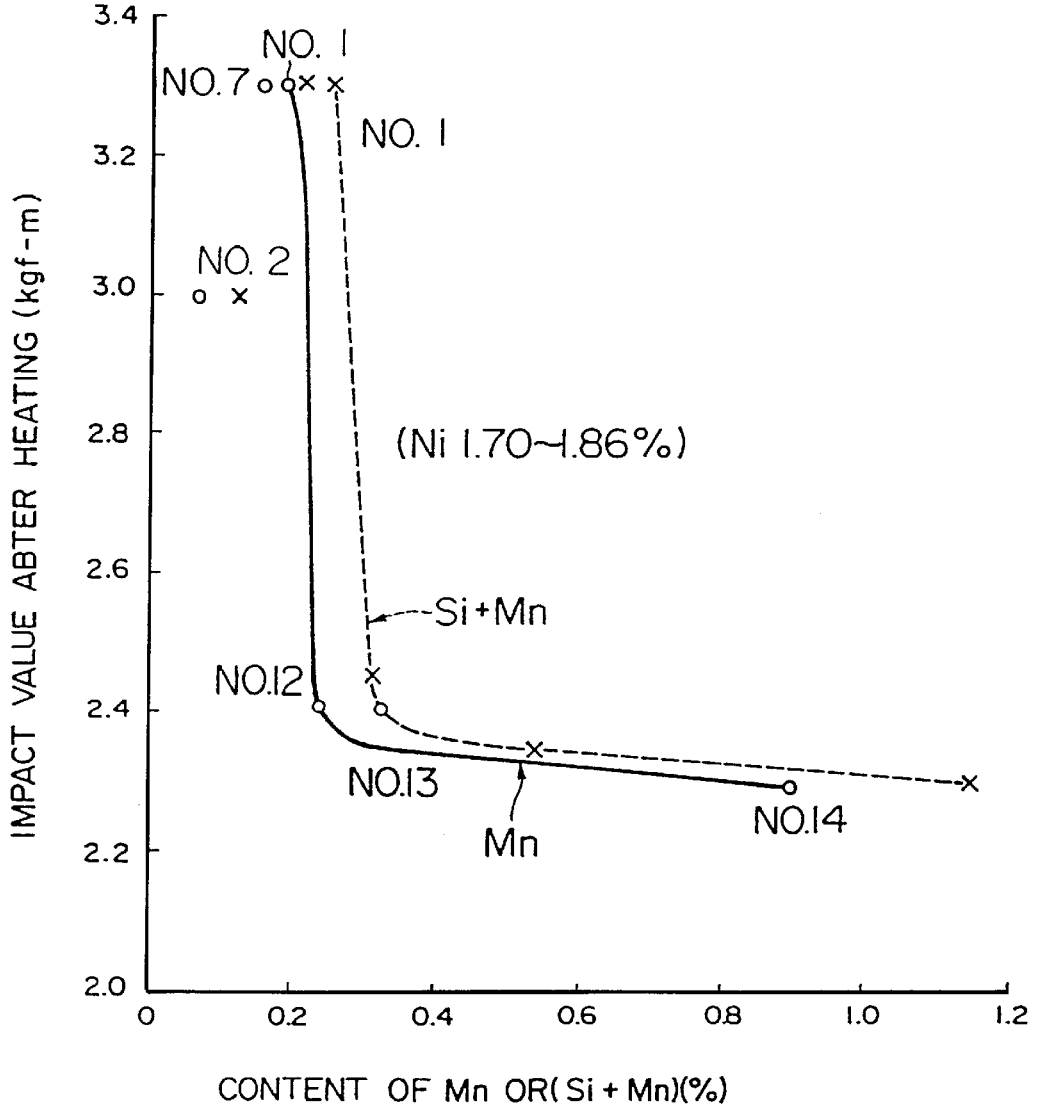

Likewise, FIG. 6 is a graph showing a relationship between impact value after being subjected to heating embrittlement and an amount of Mn or an amount of Si+Mn of the specimens containing 1.6 to 1.9% of Ni. As shown in FIG. 6, it is apparent that Mn or (Si+Mn) greatly influences the impact value at a particular amount of Ni. That is, the specimens have a very high impact value when an amount of Mn is not more than 0.2% or an amount of Si+Mn is not more than 0.25%.

Figure 7:
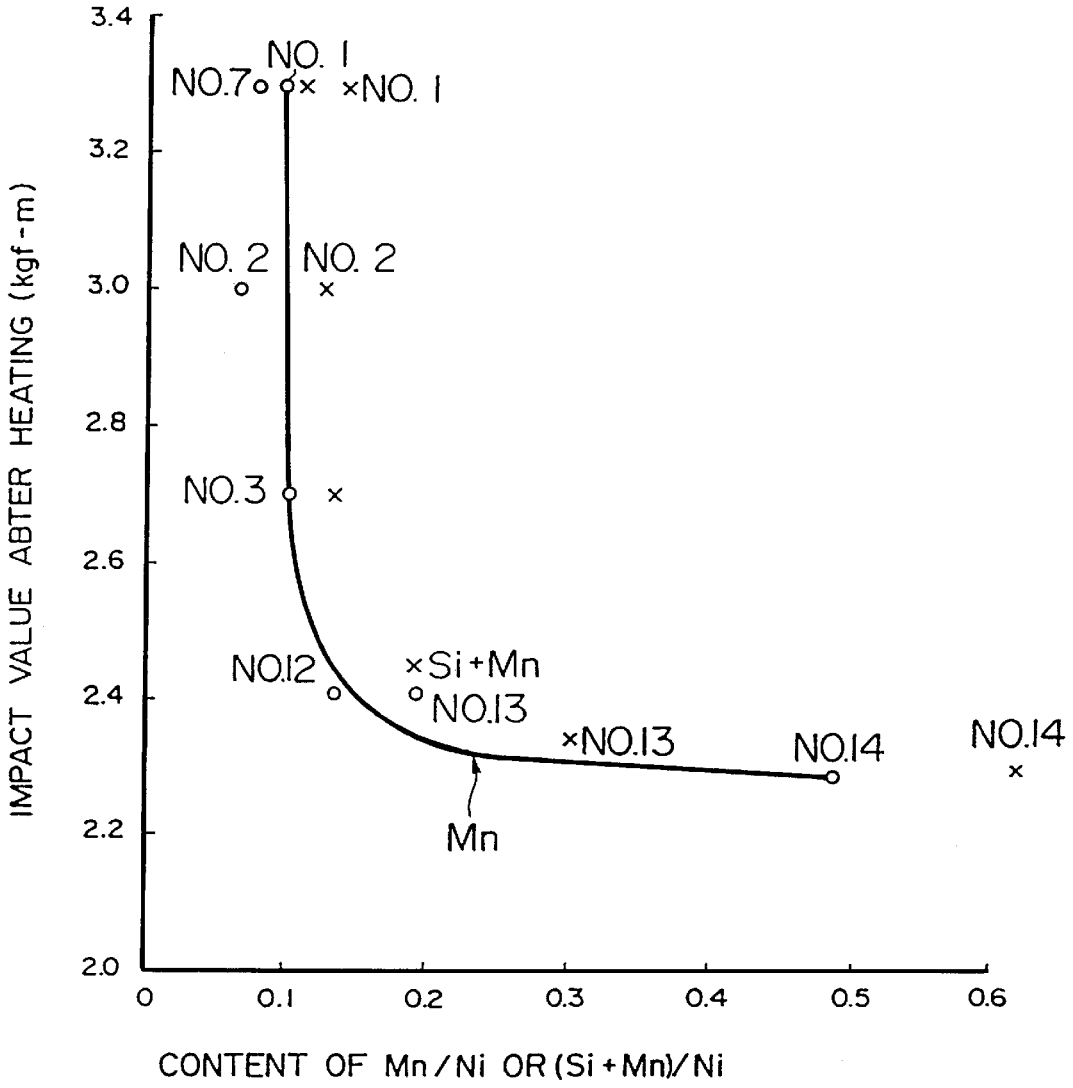

Likewise, FIG. 7 is a graph showing a relationship between an impact value and a ratio Mn/Ni or a ratio (Si+Mn)/Ni of the specimens containing 1.52 to 2.0% Ni. As shown in FIG. 7, a high impact value not less than 2.5 kgf-m is exhibited when a ratio Mn/Ni is not more than 0.12 or a ratio Si+Mn/Ni is not more than 0.18.

Example 2

Table 5 shows typical chemical compositions (wt %) of specimens used in an experiment.

The specimens were obtained in such a manner that they were melted in a high frequency melting furnace, made to an ingot, and hot forged to a size of 30 mm square at a temperature from 850 to 1250° C. The specimens Nos. 21 and 22 were prepared for the comparison with the invented materials. The specimens Nos. 23 to 32 are rotor materials superior in toughness according to the present invention.

The specimens Nos. 23 to 32 were quenched in such a manner that they were austenitized being heated to 950° C. in accordance with a simulation of the conditions of the center of a rotor shaft integrating high and low pressure portions of a steam turbine, and then cooled at a speed of 100° C./h. Next, they were annealed by being heated at 650° C. for 50 hours and cooled in a furnace. Cr—Mo—V steel according to the present invention included no ferrite phase and was made to have a bainite structure as a whole.

An austenitizing temperature of the invented steels must be 900 to 1000° C. When the temperature was less than 900° C., creep rupture strength was lowered, although superior toughness can be obtained. When the temperature exceeded 1000° C., toughness was lowered, although superior creep rapture strength was obtained. An annealing temperature must be 630 to 700° C. If the temperature is less than 630° C. superior toughness cannot be obtained, and when it exceeds 700° C., superior creep strength cannot be obtained.

Table 6 shows the results of a tensile strength test, impact test, and creep rupture test. Toughness is shown by Charpy impact absorbing energy of a V-shaped notch tested at 20° C. and 50% fracture transition temperature (FATT).

The creep rupture test by a notch was effected using specimens each having a notch bottom radius of 66 mm, a notch outside diameter of 9 mm, and a V-shaped notch configuration of 45° (a radius of a notch bottom end) "r" is 0.16 mm).

TABLE 5

| Specimen | Composition (wt %) | | | | | | | | | | | | (ppm) | V + Mo/ | Mn/ |
|---|---|---|---|---|---|---|---|---|---|---|---|---|---|---|---|
| No. | C | Si | Mn | P | S | Ni | Cr | Mo | W | V | Nb | Others | $O_2$ | Ni + Cr | Ni |
| 21 | 0.26 | 0.27 | 0.77 | 0.007 | 0.010 | 0.34 | 1.06 | 1.28 | — | 0.27 | — | — | 26 | 1.107 | 2.26 |
| 22 | 0.23 | 0.05 | 0.30 | 0.009 | 0.012 | 3.56 | 1.66 | 0.40 | — | 0.12 | — | — | 20 | 0.100 | 0.084 |
| 23 | 0.25 | 0.02 | 0.15 | 0.003 | 0.004 | 1.64 | 1.95 | 1.40 | — | 0.27 | — | — | 19 | 0.465 | 0.092 |
| 24 | 0.24 | 0.02 | 0.16 | 0.001 | 0.006 | 1.70 | 1.51 | 1.68 | — | 0.27 | 0.03 | — | 10 | 0.607 | 0.094 |
| 25 | 0.23 | 0.03 | 0.15 | 0.002 | 0.005 | 1.65 | 1.60 | 1.61 | 0.21 | 0.25 | — | — | 19 | 0.572 | 0.091 |
| 26 | 0.24 | 0.02 | 0.15 | 0.001 | 0.007 | 1.69 | 1.52 | 1.60 | 0.23 | 0.25 | 0.03 | — | 20 | 0.576 | 0.089 |
| 27 | 0.22 | 0.04 | 0.16 | 0.009 | 0.009 | 1.63 | 1.65 | 1.60 | 0.26 | 0.26 | — | Ti 0.03<br>B 0.004 | 21 | 0.567 | 0.098 |
| 28 | 0.24 | 0.06 | 0.15 | 0.005 | 0.007 | 1.65 | 1.57 | 1.68 | — | 0.23 | 0.05 | Ca 0.006 | 18 | 0.593 | 0.091 |
| 29 | 0.26 | 0.03 | 0.15 | 0.008 | 0.011 | 1.58 | 1.49 | 1.70 | — | 0.25 | 0.04 | La 0.08<br>Ce 0.09 | 16 | 0.633 | 0.094 |
| 30 | 0.23 | 0.05 | 0.14 | 0.006 | 0.008 | 1.71 | 1.51 | 1.65 | 0.27 | 0.25 | — | Al 0.006 | 16 | 0.590 | 0.082 |
| 31 | 0.26 | 0.08 | 0.13 | 0.007 | 0.006 | 1.80 | 1.50 | 1.73 | — | 0.24 | — | Ta 0.06 | 17 | 0.597 | 0.072 |
| 32 | 0.25 | 0.04 | 0.13 | 0.009 | 0.009 | 1.46 | 1.61 | 1.63 | 0.14 | 0.25 | — | Zr 0.31 | 15 | 0.612 | 0.089 |

TABLE 6

| Specimen No. | Tensile strength ($kg/mm^2$) | Elongation (%) | Contraction of area (%) | Impact absorbing energy (kg/-m) | 50% FATT (° C.) | 538° C. Creep rupture strength ($kgf/mm^2$) |
|---|---|---|---|---|---|---|
| 21 | 88.1 | 20.1 | 60.8 | 1.3 | 120 | 14.0 |
| 22 | 72.4 | 25.2 | 75.2 | 12.0 | −20 | 6.5 |
| 23 | 88.9 | 21.4 | 70.7 | 8.7 | 35 | 17.5 |
| 24 | 89.0 | 21.9 | 71.3 | 9.5 | 28 | 18.9 |
| 25 | 88.1 | 23.1 | 73.0 | 5.8 | 39 | 19.2 |
| 26 | 88.3 | 21.8 | 72.3 | 7.2 | 34 | 18.3 |
| 27 | 89.5 | 21.5 | 71.4 | 10.6 | 5 | 19.1 |
| 28 | 88.2 | 22.2 | 72.5 | 11.7 | −2 | 18.8 |
| 29 | 88.5 | 22.7 | 72.8 | 13.7 | −9 | 19.2 |
| 30 | 91.8 | 20.0 | 70.2 | 10.7 | 3 | 18.4 |
| 31 | 91.3 | 20.1 | 70.2 | 11.8 | −3 | 19.3 |
| 32 | 90.8 | 20.6 | 70.6 | 10.8 | 0 | 18.5 |

Creep rupture strength is determined by a Larson Mirror method and shown by strength obtained when a specimen was heated at 538° C. for $10^5$ hours. As apparent from Table 6, the invented materials have a tensile strength not less than 88 kgf/mm$^2$ at a room temperature, an impact absorbing energy not less than 5 kgf/mm$^2$, a 50% FATT not more than 40° C., and a creep rupture strength of 17 kgf/mm$^2$, and thus they are very useful for a turbine rotor integrating high and low pressure portions.

These invented steels have greatly improved toughness as compared with that of the material (specimen No. 21) corresponding to a material currently used to a high pressure rotor (having a high impact absorbing energy and a low FATT). Further, they have a 538° C., $10^5$ hour notch creep rupture strength superior to that of the material (specimen No. 22) corresponding to a material currently used to a low pressure rotor.

In the relationship between a ratio of a sum of V and Mo as carbide creating elements to a sum of Ni and Cr as quenching ability improving elements, and creep rapture strength and impact absorbing energy, the creep rupture strength is increased as the component ratio (V+Mo)/(Ni+Cr) is increased until it becomes about 0.7. The impact absorbing energy is lowered as the component ratio is increased. The toughness (vE20>2.5 kgf-m) and the creep rupture strength (R >11 kgf/mm$^2$) necessary as the turbine rotor integrating high and low pressure portions are obtained when (V+Mo)/(Ni+Cr) is made to be in the range of 0.45 to 0.7. Further, to examine brittle characteristics of the invented materials and the comparative material No. 21 (corresponding to a material currently used to a high pressure rotor) and the comparative material No. 22 (corresponding to a material currently used to a low pressure rotor), an impact test was effected tD specimens before subjected to a brittle treatment at 500° C. for 3000 h and those after subjected to the treatment and a 50% fracture transition temperature (FATT) was examined. As a result, an FATT of the comparative material No. 21 was increased (made brittle) from 119° C. to 135° C. (ΔFATT=16° C.), an FATT of the material, No. 2 was increased from −20° C. to 18° C. (ΔFATT=38° C.) by the brittle treatment, whereas it was also confirmed that an FATT of the invented materials were 39° C. both before and after subjected to the brittle treatment and thus it was confirmed that they were not made brittle.

The specimens Nos. 27 to 32 of the invented materials added with rare earth elements (La—Ce), Ca, Zr, and Al, respectively, have toughness improved thereby. In particular, an addition of the rare earth elements is effective to improve the toughness. A material added with Y in addition to La—Ce was also examined and it was confirmed that Y was very Effective to improve the toughness.

As a result of an examination of an influence of oxygen to creep rupture strength of the invented materials, it is found that a superior strength not less than about 12 kgf/mm$^2$ can be obtained by making $O_2$ to be in a level not more than 100 ppm, further, a superior strength not less than 15 kgf/mm$^2$ can be obtained at a level thereof not more than 800 ppm, and, furthermore, a superior strength not less than 18 kgf/mm$^2$ can be obtained at a level thereof not more than 400 ppm.

As a result of an examination of the relationship between 538° C., $10^5$ hour creep rupture strength and an amount of Ni, it is found that the creep rapture strength is abruptly lowered as an amount of Ni is increased. In particular, a strength not less than about 11 kgf/mm$^2$ is exhibited when an amount of Ni is not more than about 2%, and in particular, a strength not less than about 12 kgf/mm$^2$ is exhibited when an amount of Ni is not more than 1.9%.

Further, as a result of an examination of a relationship between impact value and an amount of Ni after the specimens have been heated at 500° C. for 3000 hours, the specimens according to the present invention in which the ratio (Si+Mn)/Ni is not more than 0.18 bring about high impact values by the increase in an amount of Ni, but the comparative specimens in which the ratio (Si+Mn)/Ni exceeds 0.18 have a low impact value not more than 2.4 kgf/mm$^2$, and thus an increase in the amount of Ni is little concerned with the impacts value.

As a result of an examination of a relationship between impact value and an amount of Mn or an amount of Si+Mn of the specimens containing 1.6 to 1.9% of Ni, it is found that Mn or Si+Mn greatly influences the impact value at a particular amount of Ni, and the specimens have a very high impact value when an amount of Mn is not more than 0.2% or an amount of Si+Mn is in a range from 0.07 to 0.25%.

As a result of an examination of a relationship between impact value and-a ratio Mn/Ni or a ratio (Si+Mn)/Ni of the specimens containing 1.52 to 2.0% of Ni, a high impact value not less than 2.5 kgf/mm$^2$ is exhibited when the ratio Mn/Ni is not more than 0.12 or the ratio (Si+Mn)/Ni is in a range from 0.04 to 0.18.

Example 3

FIG. 1 shows a partial cross sectional view of a non-reheating type steam turbine integrating high and low pressure portions according to the present invention. A conventional steam turbine consumes high pressure and temperature steam of 80 atg and 480° C. at the mein steam inlet thereof and low temperature and pressure steam of 722 mmHg and 33° C. at the exhaust portion thereof by a single rotor thereof, whereas the steam turbine integrating high and low pressure portions of the invention can increase an output of a single turbine by increasing a pressure and temperature of steam at the main steam inlet thereof to 100 atg and 536° C., respectively. To increase an output of the single turbine, it is necessary to increase a blade length of movable blades at a final stage and to increase a flow rate of steam. For example, when a blade length of the movable blade at a final stage is increased from 26 inches to 33.5 inches, an ring-shaped band area is increased by about 1.7 times. Consequently, a conventional output of 100 MW is increased to 170 MW, and further when a blade length is increase to 40 inches, an output per a single turbine can be increased by 2 times or more.

When a Cr—Mo—V steel containing 0.5% of Ni is used for a rotor integrating high and low pressure portions as a material of the rotor shaft having blades of a length not less than 33.5 inches, this rotor material can sufficiently withstand an increase in a steam pressure and temperature at the main steam inlet thereof, because this steel is superior in high temperature strength and creep characteristics to be thereby used at a high temperature region. In the case of a long blade of 26 inches, however, tangential stress in a low temperature region, in particular, tangential stress occurring at the center hole of the turbine rotor at a final stage movable blade portion is about 0.95 in a stress ratio (operating stress/allowable stress) when the rotor is rotated at a rated speed, and in the case of a long blade of 33.5 inches, the tangential stress is about 1.1 in the stress ratio, so that the above steel is intolerable to this application.

On the other hand, when 3.5% Ni—Cr—MD—V steel is used as a rotor material, the above stress ratio thereof is about 0.96 even when long blades of 33.5 inches are used, because this material has toughness in the low temperature region, and tensile strength and yield strength which are 14% higher than those of the Cr—Mo—V steel. However, long blades of 40 inches are used, the above stress ratio is 1.07, and thus this rotor material is intolerable to this application. Since this material has creep rupture stress in the high temperature region which is about 0.3 times that of the Cr—Mo—V steel and thus it is intolerable to this application due to lack of high temperature strength.

To increase an output as described above, it is necessary to provide a rotor material which simultaneously has both superior characteristics of the Cr—Mo—V steel in a high temperature region and superior characteristics of the Ni—Cr—Mo—V steel in a low temperature region.

When a long blade of a class from 30 to 40 inches is used, a material having a tensile strength not less than 88 kgf/mm$^2$ is necessary, because conventional Ni—Cr—Mo—V steel (ASTM A470 Class 7) has the stress ratio of 1.07, as described above.

Further, a material of a steam turbine rotor integrating high and low pressure portions on, which long blades not less than 30 inches are attached must have a 538° C., $10^5$ h creep rupture strength not less than 15 kgf/mm$^2$ from a view point of securing safety against high temperature breakdown on a high pressure side, and an impact absorbing energy not less than 2.5 kgf-m (3 kg-m/cm$^2$) from a view point of securing safety against breakdown due to brittleness on a low pressure side.

From the above view point, in the invention there was obtained heat resisting steels which can satisfy the above requirements and which increase an output per a single turbine.

The steam turbine according to the present invention includes thirteen stages high and low pressure portions, and steam having a high temperature and pressure of 538° C. and 88 atg, respectively, is supplied from a steam inlet 1 through a steam control valve 5. The steam flows in one direction from the inlet 1 with the temperature and pressure thereof being decreased to 33° C. and 722 mm Hg, respectively and then discharged from an outlet 2 through final stage blades 4. Since the rotor shaft integrating high and low pressure portions 3 according to the present invention is exposed to a steam temperature ranging from 538° C. to 33° C., forged steel composed of Ni—Cr—Mo—V low alloy steel having the characteristics described in the example 1 is used. The portions of the rotor shaft 3 where the blades 4 are planted are formed to a disk shape by integrally machining the rotor shaft 3. The shorter the blade is, the longer the disk portion, whereby the vibration thereof is reduced.

The steam turbine according to the embodiment of the present invention comprises one turbine room with a casing 6 being integrally formed, and two bearings, so that a space-saving is achieved.

The rotor shaft 3 according to the present invention was manufactured in such a manner that cast ingot having the alloy compositions of the specimen No. 16 shown in the example 1 and the specimen No. 24 shown in the example 2, respectively was electro-slug remelted, forged to a shaft having a diameter of 1.2 m, heated at 950° C. for 10 hours, and then the shaft was cooled at a cooling speed of 100° C./h by spraying water while the it is rotated. Next, the shaft was annealed by being heated at 665° C. for 40 hours. A test piece cut from the center of the rotor shaft was subjected to a creep test, an impact test of a V-shaped notch (a cross sectional area of the specimen: 0.8 cm$^2$) before the specimen was heated and after it had been heated (after it had been heated at 500° C. for 300 hours), and a tensile strength test, and values substantially similar to those of the examples 1 and 2 were obtained.

Each portion of the present examples are fabricated from a material having the following composition.

(1) Blade

Blades composed of three stages on a high temperature and pressure side have a length of about 40 mm in an axial direction and are fabricated from forged martensitic steel consisting, by weight, of 0.20 to 0.30% C, 10–13% Cr. 0.5 to 1.5% Mo, 0.5 to 1.5% W, 0.1 to 0.3% V, not more than 0.5% Si, not more than 1% Mn, and the balance Fe and incidental impurities.

Blades at an intermediate portion constituting fourth to twelfth stages, of which length is gradually made longer as they approach a low pressure side, are fabricated from forged martensitic steel consisting, by weight, of 0.05 to 0.15% 3, not more than 1% Mn, not more than 0.5% Si, 10 to 13% Cr, not more than 0.5% Mo, not more than 0.5% Ni, and the balance Fe and incidental impurities.

Blades having a length of 33.5 inches at a final stage, ninety pieces of which were planted around one circumference of a rotor were fabricated from forged martensitic steel consisting, by weight, of 0.08 to 0.15% C, not more than 1% Mn, not more than 0.5% Si, 10 to 13% Cr, 1.5 to 3.5% Ni, 1 to 2% Mo, 0.2 to 0.5% V, 0.02 to 0.08% N, and the balance Fe and incidental impurities. An erosion-preventing shield plate fabricated from a stellite plate was welded to the leading edge of the final stage at the terminal end thereof. Further, a partial quenching treatment was effected regarding portions other than the shield plate. Furthermore, a blade having a length not less than 40 inches may be fabricated from Ti alloy containing 5 to 7% Al and 3 to 5% V.

Each of 4 to 5 pieces of these blades in the respective stages was fixed to a shroud plate through tenons provided at the extreme end thereof and caulked to the shroud plate made of the same material as the blades.

The 12% Cr steel shown above was used to provide a blade which was rotated at 3000 rpm even in a case of its length of 40 inches. Although Ti alloy was used when a blade having a length of 40 inches was rotated at 3600 rpm, the 12% Cr steel was used to provide a blade having a length up to 33.5 inches and being rotated at 3600 rpm.

(2) Stationary blades 7 provided in the first to third stages at the high pressure side were fabricated from martensitic steel having the same composition as those of the corresponding movable blades and stationary blades other than those of the first to third stages were fabricated from martensitic steel having the same composition as those of the movable blades at the intermediate portion.

(3) A casing 6 was fabricated from Cr—Mo—V cast steel comprising by weight 0.15 to 0.3% C, not more than 0.5% Si, not more than 1% Mn, 1 to 2% Cr, 0.5 to 1.5% Mo, 0.05 to 0.2% V, and not more than 0.1% Ti.

Designated at 8 is a generator capable of generating an output of 100,000 to 200,000 KW. In the present examples, a distance between bearings 12 of the rotor shaft was about 520 cm, an outside diameter of a final blade was 316 cm, and a ratio of the distance between bearings to the outside diameter was 1.65. The generator had a generating capacity of 100,000 KW. A distance between the bearings was 0.52 m per 10,000 KW.

Further, in the present examples, when a blade of 40 inches was used at a final stage, an outside diameter thereof was 365 cm, and thus a ratio of a distance between bearings to this outside diameter was 1.43, whereby an output of 200,000 KW was generated with a distance between the bearings being 0.26 m per 10,000 KW.

In these cases, a ratio of an outside diameter of a portion of the rotor shaft where the blades were planted to a length of the final stage blade is 1.70 for a blade of 33.5 inches and 1.71 for a blade of 40 inches.

In the present examples, steam having a temperature of 566° C. was applicable, and pressures thereof of 121, 169, or 224 atg were also applicable.

Example 4

Figure 8:
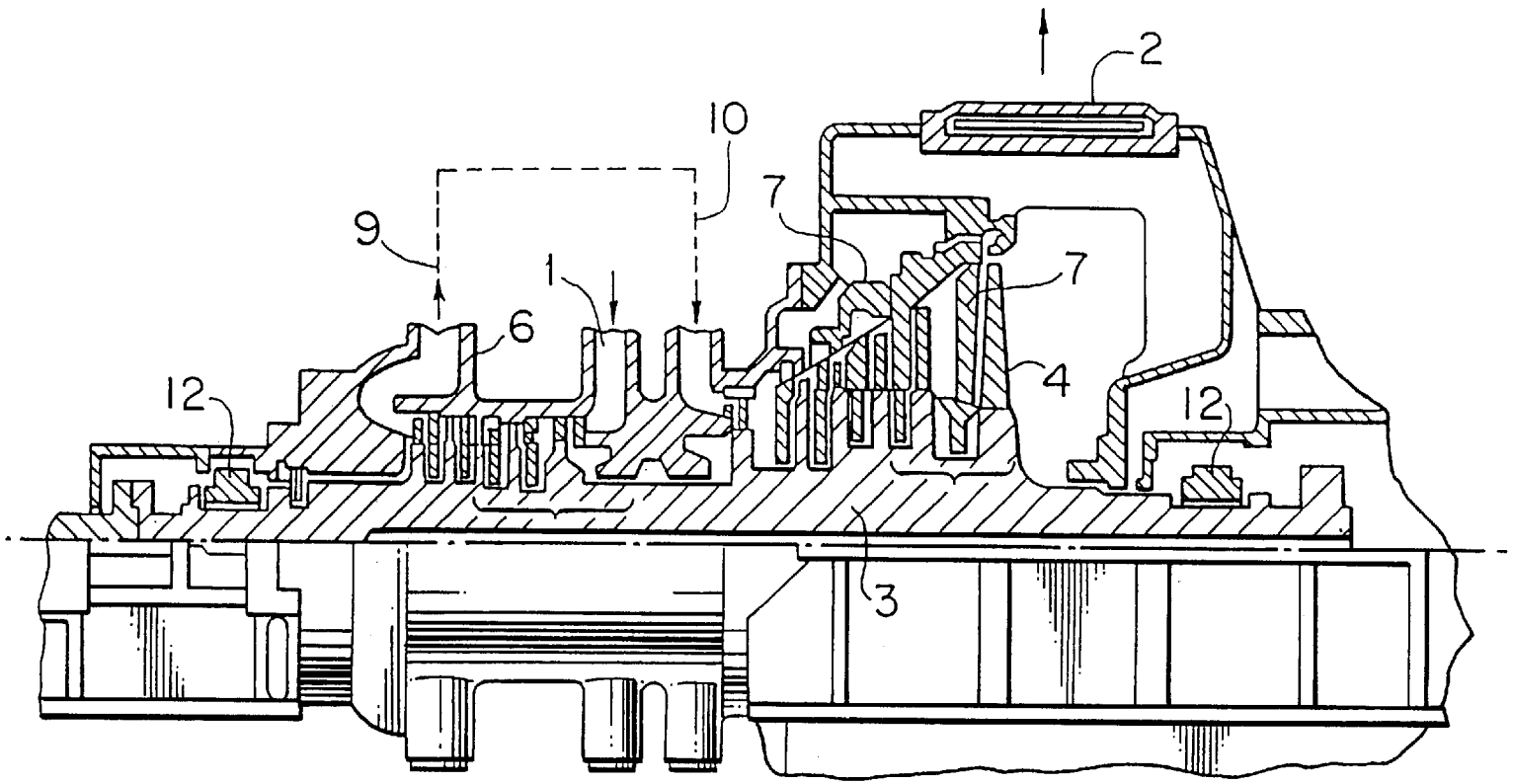

FIG. 8 is a partially taken-away sectional view of an arrangement of a reheating type steam turbine integrating high and low pressure portions. In this steam turbine, steam of 538° C. and 126 atg was supplied from an inlet 1 and discharged from an outlet 9 through a high pressure portion of a rotor 3 as steam of 367° C. and 38 atg, and further steam having been heated to 538° C. and to a pressure of 35 atg was supplied from an inlet 10, flowed to a low pressure portion of tie rotor 3 through an intermediate pressure portion thereof, and discharged from an outlet 2 as steam having a temperature of about 46° C. and a pressure of 0.1 atg. A part of the steam discharged from the outlet 9 is used as a heat source for the other purpose and then again supplied to the turbine from the inlet 10 as a heat source therefor. If the rotor for the steam turbine integrating high and low pressure portions is fabricated from the material of the specimen No. 5 of the example 1, the vicinity of the steam inlet 1, i.e., a portion a will have sufficient high temperature strength, however, since the center of the rotor 3 will have a high ductility-brittle transition temperature of 80 to 120° C., there will be caused such drawback that, when the vicinity of the steam outlet 2, i.e., a portion b has a temperature of 50° C., the turbine is not sufficiently ensured with respect to safety against brittle fracture. On the other hand, if the rotor 3 is fabricated from the material of the specimen No. 6, safety against brittle fracture thereof at the vicinity of the steam outlet 2, i.e., the portion b will be sufficiently ensured, since a ductility-brittle transition temperature at the center of the rotor 3 is lower than a room temperature, however, since the vicinity of the steam inlet 1, i.e., the portion a will have insufficient high temperature strength and since the alloy constituting the rotor 3 contains a large amount of Ni, there will be such a drawback that the rotor 3 is apt to become brittle when it is used (operated) at a high temperature for a long time. More specifically, even if any one of the materials of the specimens Nos. 5 and 6 is used, the steam turbine rotor integrating high and low pressure portions made of the material composed of the specimens No. 5 or 6 has a certain disadvantage, and thus it cannot be practically used. Note that, in FIG. 8, 4 designates a movable blade, 7 designates a stationary blade, and 6 designates a casing, respectively. A high pressure portion was composed of five stages and a low pressure portion was composed of six stages.

In this example, the rotor shaft 3, the movable blades 4, the stationary blades 7, and the casing 6 were formed of the same materials as those of the above-mentioned example 3. The movable blade at a final stage had a length not less than 33.5 inches and was able to generate an output of 120,000 KW. Similar to the example 3, 12% Cr steel or Ti alloy steel is used for this blade having length of not less than 33.5 inches. A distance between bearings 12 was about 454 cm, a final stage blade of 33.5 inches in length had a diameter of 316 cm and a ratio of the distance between the bearings to this outside diameter was 1.72. When a final stage blade of 40 inches in length was used, an output of not less than 200,000 KW was generated. The blade portion thereof had a diameter of 365 cm and a ratio of a distance between bearings to this diameter was 1.49. A distance between the bearings per a generated output of 10,000 KW in the former of 33.5 inches was 0.45 m and that in the latter of 40 inches was 0.27 m. The above mentioned steam temperature and pressures were also applicable to this example.

The steam turbine according to the embodiment of the present invention comprises one turbine room with a casing 6 being integrally formed, and two bearings, so that a space-saving is achieved.

Example 5

The rotor shaft integrating high and low pressure portions according to the present invention was also able to be applied to a single flow type steam turbine in which a part of steam of an intermediate pressure portion of a rotor shaft was used as a heat source for a heater and the like. The materials used in the example 3 were used regarding the rotor shaft, movable blades, stationary blades and casing of this example.

Example 6

Figure 10:
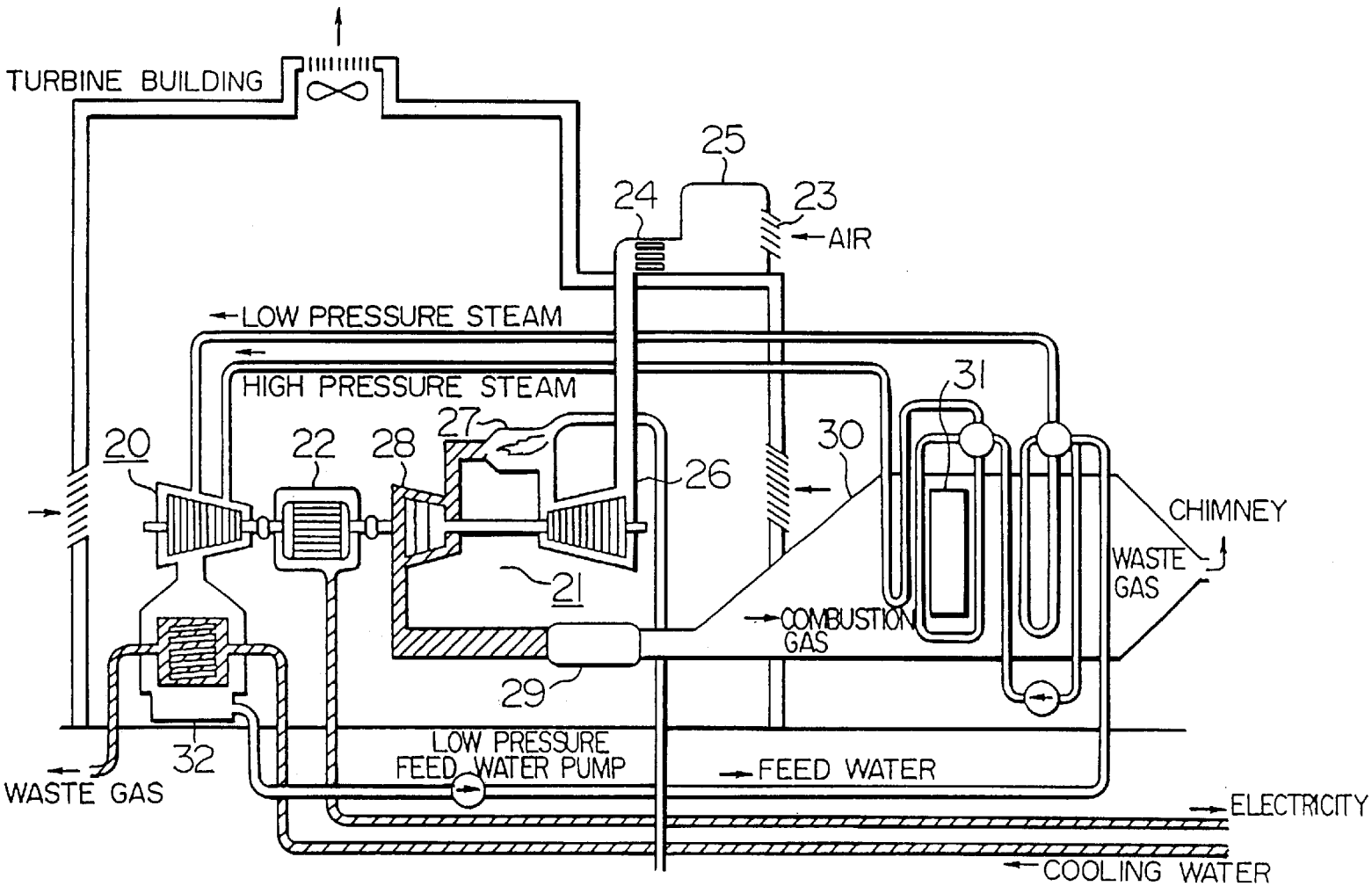
FIG. 10 is a schematic view of a single shaft combined power generation system using a steam turbine according to the present invention.

FIG. 10 is a schematic view showing a single shaft combined power generation system in which a steam turbine 20 shown in Example 3 or 4 is used. In a case where electrical energy is generated by using a gas turbine 21, nowadays there is a tendency to adopt a so-called combined power generation system in which a gas turbine 21 is driven by using liquified natural gas (LNG) as a fuel therefor while a steam turbine 20 is driven by use of a steam obtained through the recovering of the energy of waste gas discharged from the gas turbine so that the power generator 22 may be driven by both the steam turbine 20 and the gas turbine 21. By employing the combined power generation system, it is possible to remarkably enhance a heat efficiency from 40% obtained in a case of using a single conventional steam turbine up to about 44% attained in this combined power generation system.

In the combined power generation system, it is desired to make the practical use of this plant smooth and to improve the economical efficiency by altering the single fuel firing of LNG to the multi-fuel firing of the LNG and liquified petroleum gas (LPG).

First, by rotating the driving motor (not shown in FIG. 10) of the gas turbine, air entered the air compressor 26 of a gas turbine 21 through an air filter 23 and an air intake silencer 24 both provided in an air intake chamber 25, and the air compressor compressed air and fed the compressed air to a low $NO_x$ combustor 27.

In the combustor 27, when the rotation number thereof became about not less than about 2000 RPM, a fuel was jetted in the compressed air for combustion to thereby generate high temperature gas of not less than 1100° C., which high temperature gas was made to work in the turbine 28 to thereby generate power.

The waste gas of not less than 530° C. discharged from the turbine 28 was fed to a waste heat recovery boiler 30 through an exhaust silencer 29 so that the heat energy of the waste gas discharged from the gas turbine was recovered to generate high pressure steam not less than 530° C. in temperature. In this boiler 30 there was provided a $NO_x$ removal system in which the reducing thereof occurred through contact with dry ammonia. The waste gas was discharged outwardly through a tripod-shaped chimney of several hundred meters in height. In an initial operation period of the gas turbine, steam of not more than 500° C. occurring in the waste heat recovery boiler 30 when the gas turbine 21 began to be driven was made to flow into the steam turbine to thereby be used for cooling the steam turbine at the initial operation period thereof. The generated high pressure steam of not less than 530° C. was fed to the steam turbine comprising the mono-block rotor integrating the high and low pressure sides.

Further, the steam discharged from the steam turbine 20 was made to flow into a condenser 32 in which the steam was vacuum-deaerated to be condensate, the condensate being then fed to a boiler after the pressure had been risen by a condensate pump. The gas turbine and the steam turbine drove one end of and another end of the shaft of the generator, respectively, to thereby effect the power generation. In order to cool the blades of the gas turbine used in the combined power generation, steam may be used as cooling medium which steam is used in the steam turbine. In general, air is used as a cooling medium for cooling the blades. However, the cooling effect of the steam is high because the steam has a very large specific heat in comparison with that of air and because the weight thereof is relatively small. In a case where steam to be used for cooling is discharged into a main flow gas, the temperature of the main flow gas is abruptly lowered to reduce the efficiency of the whole plant due to the large specific heat of the steam. Thus, relatively low temperature steam (for example, about 800° C.) was fed from a cooling medium-feeding opening of the gas turbine blades so as to cool the body of the blades to thereby effect the heat exchange so that the cooling medium becoming relatively high in temperature (for example, about 900° C.) may be recovered and may be returned to the steam turbine. By this constitution, it was possible to prevent the main flow gas temperature (about 1100° to 1500° C.) from being lowered and to enhance both the efficiency of the steam turbine and the efficiency of the whole of the plant. According to the combined power generation system, it was possible to obtain the power generation of about 40,000 KW regarding the gas turbine and about 60,000 KW regarding the steam turbine, that is, 100,000 KW in total. In addition, since the steam turbine embodying the present invention became compact in size, the economical production in comparison with a conventional large-size steam turbine was possible with respect to the same power generation capacity, and there was obtained such advantage that economical operation was possible with respect to the variation of the amount of power generation.

Figure 11:
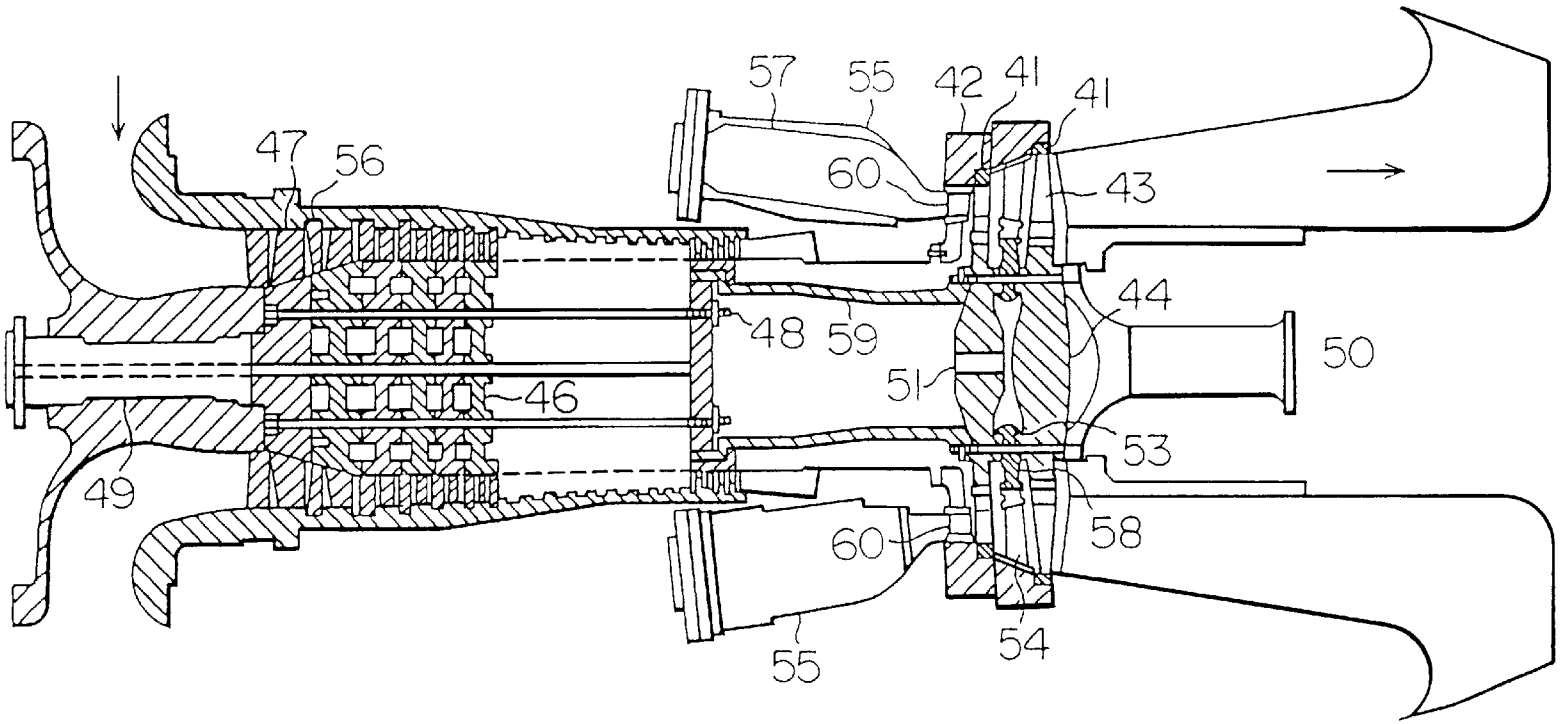
FIG. 11 is a sectional view of the rotation portion of a gas turbine according to the present invention.

FIG. 11 is a sectional view of the rotation portion of a gas turbine, wherein 50 is a turbine stub shaft, 43 being turbine buckets (moving blades), 53 being turbine stacking bolts, 58 being turbine spacers, 59 being a distant piece, 60 being a nozzle (a stationary blade), 46 being compressor disks, 47 being compressor blades, 48 being compressor stacking bolts, 49 being a compressor stub shaft, 44 being a turbine disk, and 51 being an opening. The gas turbine of this embodiment was made to have the compressor disks 46 of 17 stages and the turbine buckets 43 of 3 stages (one stage is omitted). The moving blades is made of a γ' precipitation type Ni-based super alloy, the static blade being made of a carbide-crystallizing type Co-based super alloy containing Mo and/or W, and the turbine disk being made of a heat-resisting steel of martensitic structure containing Cr, Mo and V. With respect to the form, the gas turbine 21 of this embodiment was made to comprise a heavy duty form, one shaft form, a horizontally divided casing, and a stacking type rotor, the compressor 26 comprising a 17 stage axial flow form, the turbine 28 comprising a three stage impulse form, the first and second stages being stationary blades cooled by air, the combustor 27 comprising a berth-flow form, 16 cans and slot-cooling system.

The disc was formed of three stages, wherein a movable blade was fabricated from Ni base cast alloy containing by weight 0.04 to 0.1% C, 12 to 16% Cr, 3 to 5% Al, 3 to 5% Ti, 2 to 5% Mo, and 2 to 5% Ni and a stationary blade was fabricated from Co base cast alloy containing by weight 0.25 to 0.45 C, 20 to 30% Cr, 2 to 5% at least one selected from the group consisting of Mo and W, and 0.1 to 0.5% at least one selected from the group consisting of Ti and Nb. A burner liner was fabricated from Fe—Ni—Cr austenitic alloy containing by weight 0.05 to 0.15% C, 20 to 30% Cr, 30 to 45% Ni, 0.1 to 0.5% at least one selected from the group consisting of Ti and Nb, and 2 to 7% at least one selected from the group consisting of Mo and W. A heat shielding coating layer made of a $Y_2O_2$ stabilizing zirconia sprayed onto the outer surface of the liner was provided to the flame side of the liner. Between the Fe—Ni—Cr austenitic alloy and the zirconia layer was disposed a MCrAlY alloy layer consisting, by weight, of 2 to 5% Al, 20 to 30% Cr, 0.1 to 1% Y, and at least one selected from the group consisting of Fe, Ni and Co, that is, M is at least one selected from the group consisting of Fe, Ni and Co.

An Al-diffused coating layer was provided on the movable and stationary blades shown above.

A material of the turbine disc was fabricated from a martensitic forged steel containing by weight 0.15 to 0.25% C, not more than 0.5% Si, not more than 0.5% Mn, 1 to 2% Ni, 10 to 13% Cr, 0.02 to 0.1% at least one selected from the group consisting of Nb and Ta, 0.03 to 0.1% N, and 1.0 to 2.0% Mo; a turbine spacer, distant piece and compressor disc at a final stage being fabricated from the same martensitic steel, respectively.

A series of constitution of the plant was made to have six pairs of power generation systems each comprising a motor for driving, a gas turbine 21, a waste gas-recovery boiler 30, a steam turbine, and a generator 22.

In the gas turbine, air was compressed and LNG was made to burn therein to thereby generate high temperature combustion gas, which was then used to rotate the turbine to thereby drive the generator directly connected thereto.

Regarding the ratio of the power generation, about ⅓ was obtained by the gas turbine and about ⅔ was obtained by the steam turbine.

The combined power generation system was able to bring about the advantages explained below. The heat efficiency was enhanced by 2 to 3% in comparison with conventional steam power generation. Further, even in a case of partial load, it was possible to operate, the plant in the vicinity of the rated load, at which a high heat efficiency is obtained, by reducing the number of operating gas turbines, with the result that high heat efficiency was maintained with respect to the whole of the plant.

The combined power generation is constituted by the combination of a. gas turbine in which the start/stop is readily effected in a short period of time and a steam turbine which is small in size and simple in construction, so that it is readily possible to reguate the output thereof. Thus, the combined power generation is very appropriate as an intermediate load steam power generation which is able to immediately meet the variation of demand. A starting time of one series up to 100% output was about 45 minutes, and another starting time of six series up to 100% output was about 90 minutes, that is, the starting times were very short.

The reliability of the gas turbine is remarkably increasing because of recent development of technique, and the combined power generation plant is constituted by the combination of a plurality of devices of small capacity. Thus, even if there occurs an accident, it is possible to limit the influence thereof to a local portion, that is, the combined power generation system is an electric power source having high reliability.

Example 7

Figure 9:
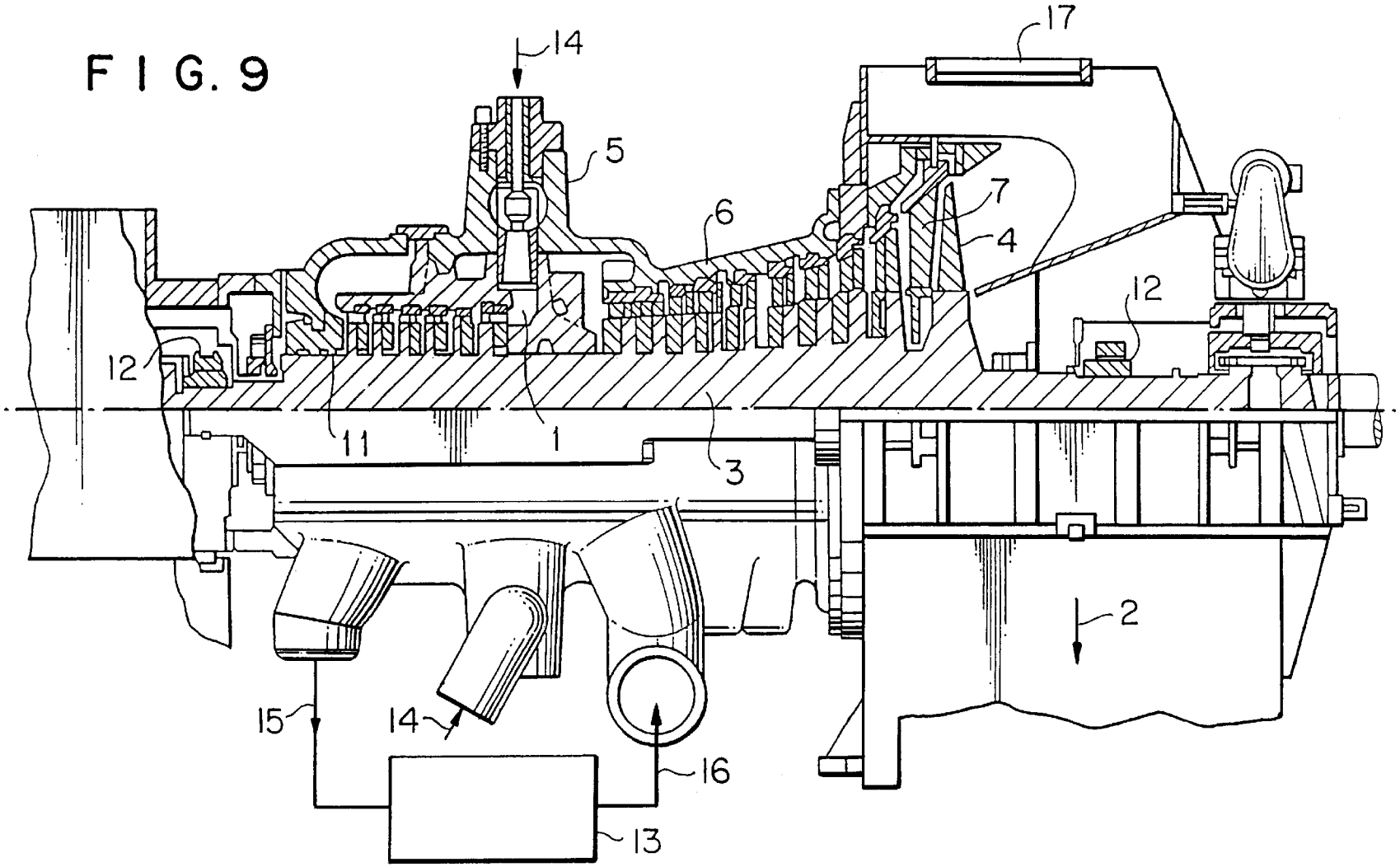

FIG. 9 is a partially sectional view of a reheating type steam turbine integrating high and low pressure portions according to the present invention, wherein the left side of FIG. 9 is a high temperature and high pressure turbine portion and the right side thereof is a high temperature and intermediate, low pressure turbine portion. A rotor shaft integrating high and low pressure portions 3 used in this example was fabricated from the Ni—Cr—MO—V steel having the bainite structure as a whole described in the example 3. The left side is a high pressure side and the right side is a low pressure side in FIG. 9, and a final stage blade had a length of 33.5 or 40 inches. Blades on the left high pressure side were made of the same material as that described in the example 3 and final stage blades were made of the same material as that described in the Example 3. Steam of this example had a temperature of 538° C. and a pressure of 102 kg/cm$^2$ at an inlet and had an temperature no more than 46° C. and a pressure not more than an atmospheric pressure at an outlet, which steam was supplied to a condenser as shown by numeral 2. A material of the rotor shaft of this example had an FATT not more than 40° C., a V-shaped notch impact value at a room temperature not less than 4.8 kgf-mm$^2$ (a cross sectional area: not less than 0.8 cm$^2$), a tensile strength at a room temperature not less than 81 kgf/mm$^2$, a 0.2 yield strength not less than 63 kgf/mm$^2$, an elongation not less than 16%, a contraction of area not less than 45 percent, and a 538° C., $10^5$ hour creep rupture strength not less than 11 kgf/mm$^2$. Steam was supplied from an inlet 14, discharged from an outlet 15 through high pressure side blades, again supplied to a reheater 13, and supplied to a low pressure side as high temperature steam of 538° C. and 35 atg. Designated at 12 are bearings disposed at the opposite sides of the rotor shaft 3, and a distance between bearings was about 6 m. The rotor of this example rotated at 3600 rpm and generated an output of 200,000 KW. Blades 4 were composed of six stages on the high pressure side and ten stages on the low pressure side. In this example, a distance between bearings was 0.3 m per a generated output of 10,000 KW, and thus the distance was about 40% shorter than a conventional distance of 0.66 m.

Further, in this example, a final stage blade of 33.5 inches had a diameter of 316 cm and thus a ratio of a distance between the bearings to this outside diameter was 2.22. In another case, a final stage blade of 40 inches having a diameter of 365 cm was used, a ratio of the distance between the bearings to the diameter being 1.92, which enables an output of not less than 200,000 KW to be generated. As a result, a distance between the bearings per a generated output of 10,000 KW was 0.3 m in this another case, whereby the steam turbine was able to be made very compact.

The steam turbine according to the embodiment of the present invention comprises one turbine room with a casing 6 being integrally formed, and two bearings, so that a space-saving is achieved.

Example 8

A large-size rotor was produced by use of an alloy steel shown in Table 7. The melting of the alloy steel was effected in a basic electric furnace, the refining thereof being sufficiently effected in a ladle. When producing an ingot, the refined alloy steel was vacuum-cast and was subjected to vacuum carbon deoxidation. The resultant ingot was hot-forged at 850° C. to 1200° C. by use of a hydraulic forging press to thereby obtain a rotor having a low pressure portion of 1750 mm in diameter, a high pressure portion of 1300 mm in diameter, and a rotor length of 6000 mm in length. The tempering heat treatment of the rotor was effected by the steps of heating up to 950° C., quenching by water jetting cooling, and tempering two times at 630° C. and 645° C. The mechanical properties of the rotor portions are shown in Table 8, that is, the rotor had such superior properties that the tensile strength thereof is not less than 88 Kgf/mm$^2$, impact-absorption energy being not less than 4.4 Kgf-m, and no embrittlement occurred.

TABLE 7

| (wt. %) | | | | | | | | | | |
|---|---|---|---|---|---|---|---|---|---|---|
| C | Si | Mn | P | S | Ni | Cr | Mo | V | $O_2$ | Fe |
| 0.24 | 0.02 | 0.20 | 0.004 | 0.003 | 1.78 | 2.05 | 1.20 | 0.27 | 0.0015 | Balance |

TABLE 8

| | Tensile | .02% Yield | Elon- | Contra- | Impact absorbing energy (kgf-m) | | 50% FATT (° C.) | | 538° C., $10^5$ h |
|---|---|---|---|---|---|---|---|---|---|
| | Strength (kgf/mm$^2$) | strength (kgf/mm$^2$) | gation (%) | ction of Area (%) | Prior to embrittlement | After embrittlement | Prior to embrittlement | After* embrittlement | Creep rupture Strength (kgf/mm$^2$) |
| Low Pressure Portion | | | | | | | | | |
| Outer layer portion | 88.2 | 70.1 | 21 | 70 | 15.0 | — | −40 | — | — |

TABLE 8-continued

| | Tensile Strength (kgf/mm$^2$) | .02% Yield strength (kgf/mm$^2$) | Elon-gation (%) | Contra-ction of Area (%) | Impact absorbing energy (kgf-m) Prior to embrittlement | Impact absorbing energy (kgf-m) After embrittlement | 50% FATT (° C.) Prior to embrittlement | 50% FATT (° C.) After* embrittlement | 538° C., $10^5$ h Creep rupture Strength (kgf/mm$^2$) |
|---|---|---|---|---|---|---|---|---|---|
| Center portion High Pressure Portion | 89.5 | 70.8 | 19 | 60 | 4.6 | 4.4 | 49 | 50 | — |
| Outer layer Portion | 88.3 | 70.1 | 21 | 70 | 16.2 | — | −40 | — | — |
| Center Portion | 88.7 | 70.3 | 20 | 64 | 4.5 | 4.4 | 55 | 55 | 17.2 |

*500° C., 3000 h

What is claimed is:

1. A steam turbine having a rotor provided with a mono-block rotor shaft, multi-stage blades fixed on the mono-block rotor shaft from a high pressure side at which a steam inlet temperature of first stage blades is not less than 530° to a low pressure side at which are provided final stage blades having a length not less than 40 inches for the mono-block rotor shaft rotated at 3000 rpm or a length not less than 33.5 inches for the mono-block rotor shaft rotated at 3600 rpm, said final stage blades comprising a Ti-based alloys:

wherein at least the first stage blades at the high pressure side comprise a martensitic steel containing, by weight, 0.20 to 0.30% C, not more than 0.5% Si, not more than 1% Mn, 10 to 13% Cr, 0.5 to 1.5% Mo, 0.5 to 1.5% W, and 0.1 to 0.35% V; and wherein remaining blades, with the exception of said at least first stage blades at the high pressure side made of said martensitic steel and said final stage blades, comprise a martensitic steel containing by weight, 0.05 to 0.15% C, not more than 0.5% Si, not more than 1% Mn, 10 to 13% Cr, not more than 0.5% Ni, and not more than 0.5% Mo.

2. A steam turbine according to claim 1, wherein said mono-block rotor shaft is supported by bearings, and wherein said Ti-based alloy contains by weight 5–7% Al and 3–5% V.

3. A high and low pressure sides-integrating steam turbine, comprising a rotor provided with a mono-block rotor shaft and multi-stage blades fixed on the mono-block rotor shaft from a high pressure side to a low pressure side of the turbine at which are provided final stage blades having a length not less than 40 inches for the mono-block rotor shaft rotated at 3000 rpm or a length not less than 33.5 inches for the mono-block rotor shaft rotated at 3600 rpm, said final stage blades comprising a Ti-based alloy, and a casing covering the rotor, said mono-block rotor shaft extending from the high pressure side at which steam having a temperature not less than 530° C. is introduced onto the first stage blades, said steam turbine further comprising a high temperature and high pressure turbine portion, and a high temperature and intermediate pressure to low temperature and low pressure turbine portion in which a high temperature and intermediate pressure state is shifted to a low pressure state, and wherein steam flowing out of the high temperature and high pressure turbine portion is re-heated and is introduced in the high temperature and intermediate pressure side of the high temperature and intermediate pressure to low temperature and low pressure turbine portion; wherein at least first stage blades at the intermediate pressure side or at each of said high pressure side and said intermediate pressure side comprise a martensitic steel containing, by weight, 0.20 to 0.30% C, not more than 0.5% Si, not more than 1% Mn, 10 to 13% Cr, 0.5 to 1.5% Mo, 0.5 to 1.5% W, and 0.1 to 0.35% V; and wherein remaining blades, with the exception of said at least first stage blades at the intermediate pressure side or at the high and intermediate pressure side made of said martensitic steel and said final stage blades, comprise a martensitic steel containing, by weight, 0.05 to 0.15% C, not more than 0.5% Si, not more than 1% Mn, 10 to 13% Cr, not more than 0.5% Ni, and not more than 0.5% Mo.

4. A steam turbine having a rotor provided with a mono-block rotor shaft, multi-stage blades fixed on the mono-block rotor shaft from a high pressure side at which a steam inlet temperature of first stage blades is not less than 566° C. to a low pressure side at which are provided final stage blades having a length not less than 30 inches and comprising a Ti-based alloy;

wherein at least the first stage blades at the high pressure side comprise a martensitic steel containing, by weight, 0.20 to 0.30% C, not more than 0.5% Si, not more than 1% Mn, 10 to 13% Cr, 0.5 to 1.5% Mo, 0.5 to 1.5% W, and 0.1 to 0.35% V; and wherein remaining blades, with the exception of said at least first stage blades at the high pressure side made of said martensitic steel and said final stage blades, comprise a martensitic steel containing, by weight, 0.05 to 0.15% C, not more than 0.5% Si, not more than 1% Mn, 10 to 13% Cr, not more than 0.5% Ni, and not more than 0.5% Mo.

5. A steam turbine according to claim 4, wherein said mono-block rotor shaft is supported by bearings, and wherein said Ti-based alloy contains, by weight, 5–7% Al and 3–5% V.

6. A steam turbine having a rotor provided with a mono-block rotor shaft, multi-stage blades fixed on the mono-block rotor shaft from a high pressure side at which a steam inlet temperature of first stage blades is not less than 566° C. to a low pressure side at which are provided final stage blades having a length not less than 30 inches, said final stage blades comprising a martensitic steel containing 10 to 13 wt. % Cr;

wherein at least the first stage blades at the high pressure side comprise a martensitic steel containing, by weight, 0.20 to 0.30% C, not more than 0.5% Si, not more than 1% Mn, 10 to 13% Cr, 0.5 to 1.5% Mo, 0.5 to 1.5% W, and 0.1 to 0.35% V; and wherein remaining blades, with the exception of said at least first stage blades at the high pressure side made of said martensitic steel and said final stage blades comprise a martensitic steel containing, by weight, 0.05 to 0.15% C, not more than 0.5% Si, not more than 1% Mn, 10 to 13% Cr, not more than 0.5% Ni, and not more than 0.5% Mo.

7. A steam turbine according to claim 6, wherein said martensitic steel of which said final stage blades are comprised further contains, by weight, 0.08 to 0.15% C, not more than 0.5% Si, not more than 1% Mn, 1.5 to 3.5% Ni, 1 to 2% Mo, 0.2 to 0.5% V, and 0.02 to 0.08% N.

8. A steam turbine having a rotor provided with a mono-block rotor shaft, multi-stage blades fixed on the mono-block rotor shaft from a high pressure side at which a steam inlet temperature of first stage blades is not less than 530° C. to a low pressure side at which are provided final stage blades having a length not less than 40 inches for the mono-block rotor shaft rotated at 3000 rpm or a length not less than 33.5 inches for the mono-block rotor shaft rotated at 3600 rpm;

wherein at least the first stage blades at the high pressure side comprise a martensitic steel containing, by weight, 0.20 to 0.30% C, not more than 0.5% Si, not more than 1% Mn, 10 to 13% Cr, 0.5 to 1.5% Mo, 0.5 to 1.5% W, and 0.1 to 0.35% V; and wherein remaining blades, with the exception of said at least first stage blades at the high pressure side made of said martensitic steel and said final stage blades comprise a martensitic steel containing, by weight 0.05 to 0.15% C, not more than 0.5% Si, not more than 1% Mn, 10 to 13% Cr, not more than 0.5% Ni, and not more than 0.5% Mo.

9. A high and low pressure sides-integrating steam turbine, comprising a rotor provided with a mono-block rotor shaft and multi-stage blades fixed on the mono-block rotor shaft from a high pressure side to a low pressure side of the turbine at which are provided final stage blades having a length not less than 40 inches for the mono-block rotor shaft rotated at 3000 rpm or a length not less than 33.5 inches for the mono-block rotor shaft rotated at 3600 rpm, and a casing covering the rotor, said mono-block rotor shaft extending from the high pressure side at which steam having a temperature not less than 530° C. is introduced onto the first stage blades, said steam turbine further comprising a high temperature and high pressure turbine portion, and a high temperature and intermediate pressure to low temperature and low pressure turbine portion in which a high temperature and intermediate pressure state is shifted to a low pressure state, and wherein steam flowing out of the high temperature and high pressure turbine portion is re-heated and is introduced in the high temperature and intermediate pressure side of the high temperature and intermediate pressure to low temperature and low pressure turbine portion;

wherein at least first stage blades at the intermediate pressure side or at each of said high pressure side and said intermediate pressure side comprise a martensitic steel containing, by weight, 0.20 to 0.30% C, not more than 0.5% Si, not more than 1% Mn, 10 to 13% Cr, 0.5 to 1.5% Mo, 0.5 to 1.5% W, and 0.1 to 0.35% V; and wherein remaining blades, with the exception of said at least first stage blades at the intermediate pressure side or at the high and intermediate pressure side made of said martensitic steel and the final stage blades, comprise a martensitic steel containing, by weight, 0.05 to 0.15% C, not more than 0.5% Si, not more than 1% Mn, 10 to 13% Cr, not more than 0.5% Ni, and not more than 0.5% Mo.

10. A high and low pressure sides-integrating steam turbine, comprising a rotor provided with a mono-block rotor shaft and multi-stage blades fixed on the mono-block rotor shaft from a high pressure side to a low pressure side of the turbine, and a casing covering the rotor, said mono-block rotor shaft extending from the high pressure side at which steam having a temperature not less than 566° C. is introduced onto the first stage blades, said steam turbine further comprising a high temperature and high pressure turbine portion, and a high temperature and intermediate pressure to low temperature and low pressure turbine portion in which a high temperature and intermediate pressure state is shifted to a low pressure state, and wherein steam flowing out of the high temperature and high pressure turbine portion is re-heated and is introduced in the high temperature and intermediate pressure side of the high temperature and intermediate pressure to low temperature and low pressure turbine portion;

wherein at least first stage blades at the intermediate pressure side or at each of said high pressure side and said intermediate pressure side comprise a martensitic steel containing, by weight, 0.20 to 0.30% C, not more than 0.5% Si, not more than 1% Mn, 10 to 13% Cr, 0.5 to 1.5% Mo, 0.5 to 1.5% W, and 0.1 to 0.35% V; and wherein remaining blades, with the exception of said at least first stage blades at the intermediate pressure side or at the high and intermediate pressure side made of said martensitic steel and said final stage blades, comprise a martensitic steel containing, by weight, 0.05 to 0.15% C, not more than 0.5% Si, not more than 1% Mn, 10 to 13% Cr, not more than 0.5% Ni, and not more than 0.5% Mo.

* * * * *